US006230609B1

(12) United States Patent
Bender et al.

(10) Patent No.: US 6,230,609 B1
(45) Date of Patent: May 15, 2001

(54) FLUOROPOLYMER DIAPHRAGM WITH INTEGRAL ATTACHMENT DEVICE

(75) Inventors: Michael J. Bender, Marengo; Richard E. Fingar, Jr., Carol Stream; Rueben Wucki, deceased, late of Dundee, all of IL (US), by Shirley A Wucki legal representative

(73) Assignee: Norton Performance Plastics Corporation, Elk Grove, IL (US)

( * ) Notice: Subject to any disclaimer, the term of this patent is extended or adjusted under 35 U.S.C. 154(b) by 0 days.

(21) Appl. No.: 09/325,114

(22) Filed: Jun. 3, 1999

(51) Int. Cl.[7] ..... F01B 19/00
(52) U.S. Cl. ..... 92/99; 92/103 R
(58) Field of Search ..... 92/97, 99, 98 R, 92/103 R

(56) References Cited

U.S. PATENT DOCUMENTS

| | | | | |
|---|---|---|---|---|
| 1,388,123 | | 8/1921 | Roberts . | |
| 2,781,552 | | 2/1957 | Gray . | |
| 3,444,018 | | 5/1969 | Hewitt . | |
| 3,577,850 | | 5/1971 | Harris, Sr. . | |
| 4,238,992 | | 12/1980 | Tuck, Jr. . | |
| 4,334,838 | * | 6/1982 | Fessler et al. | 92/99 X |
| 4,566,924 | | 1/1986 | Hara et al. . | |
| 4,596,268 | | 6/1986 | Jonas . | |
| 4,632,947 | | 12/1986 | Wolki . | |
| 4,710,331 | | 12/1987 | Nobuo et al. . | |
| 4,773,519 | * | 9/1988 | Candle et al. | 92/92 X |
| 4,780,035 | | 10/1988 | Shibayama et al. . | |
| 4,849,041 | | 7/1989 | Ward et al. . | |
| 4,950,499 | | 8/1990 | Martin et al. . | |
| 4,989,497 | * | 2/1991 | Lerma | 92/103 F X |
| 5,027,693 | | 7/1991 | Wilkinson . | |
| 5,049,232 | * | 9/1991 | Tola | 156/630 |
| 5,217,797 | * | 6/1993 | Knox et al. | 92/103 F X |
| 5,349,896 | | 9/1994 | Delaney, III et al. | 92/103 R X |
| 5,374,473 | * | 12/1994 | Knox et al. | 428/218 |
| 5,511,462 | | 4/1996 | Itoi et al. . | |
| 5,542,300 | | 8/1996 | Lee . | |
| 5,560,279 | * | 10/1996 | Connors et al. | 92/103 SD X |
| 5,634,391 | | 6/1997 | Eady | 92/98 R X |
| 5,743,169 | | 4/1998 | Yamada | 92/103 F X |
| 5,758,565 | | 6/1998 | Yamada . | |
| 6,080,685 | * | 6/2000 | Eady et al. | 92/103 R X |

FOREIGN PATENT DOCUMENTS

| | | | | |
|---|---|---|---|---|
| 914586 | * | 1/1963 | (GB) | 92/103 R |

* cited by examiner

*Primary Examiner*—John E. Ryznic
(74) *Attorney, Agent, or Firm*—Volker Ulbrich; Mary E. Porter; Sampson & Associates

(57) ABSTRACT

A pump diaphragm includes a layer fabricated from polytetrafluoroethylene (PTFE) and an integral stud. In one embodiment, the stud is encapsulated within a hub assembly fabricated from PTFE and fastened to the PTFE layer with adhesive or welding, etc. In alternate embodiments, the stud may be molded in-situ with the PTFE layer using various methodology, including pressing the stud onto a heated PTFE layer. The PTFE layer then may be subjected to various forming operations to provide the diaphragm with desired dimensions and/or properties. Moreover, an additional layer or layers, such as an elastomeric layer, may be laminated onto an inside surface of the PTFE layer to provide a composite pump diaphragm.

54 Claims, 17 Drawing Sheets

FLUOROPOLYMER DIAPHRAGM WITH INTEGRAL ATTACHMENT DEVICE

BACKGROUND OF THE INVENTION

1. Field of the Invention

This invention relates to diaphragms for use in pumps and valves, and more particularly to a diaphragm including a solid polytetrafluoroethylene layer and an integral attachment stud.

2. Background Information

Diaphragm pumps are used in pumping a wide variety of materials especially when the materials are abrasive, have high viscosity, or consist of slurries that might damage other pump designs. These pumps are often air driven which is advantageous in pumping flammable liquids or in environments where electrically driven equipment could otherwise be hazardous. However, electrically or otherwise mechanically driven designs also find wide utility. Due to the wide range of different materials these pumps are used to move, a correspondingly wide variety of materials are used in the pump construction. These include plastics and metals. For the same reason the critical driving member, i.e., the pump diaphragm, typically must be manufactured from a variety of materials.

Chemically resistant layers, such as those made of polytetrafluoroethylene (PTFE), are widely used in industry to protect sensitive parts of machinery or equipment from the corrosive effects of acids or other chemicals. One such use is in two piece pump diaphragms commonly used with air or electrically driven diaphragm pumps. In the two piece diaphragms, an outer PTFE overlay diaphragm is commonly used to protect an inner rubber diaphragm from materials that would cause rapid failure of the rubber part alone. In other cases, the PTFE provides the sole material of construction of the diaphragm.

In some applications, it is desirable to provide a diaphragm having a centrally disposed stud instead of an aperture, for securing the diaphragm to the operative portion of the pump. These studs are generally fastened to the diaphragms mechanically, such as by passing the stud through a central aperture of the diaphragm and securing it by threaded fasteners, etc. This approach, however, tends to provide a working face of the diaphragm that is uneven. Moreover, the hole in the center of the diaphragm through which the shaft extends, is a potential source of leakage and the fastener and/or washer presents a geometry which is difficult to clean for sanitary applications, such as food processing. In particular, this construction provides crevices and the like between the stud (and/or fastener) and the diaphragm which tend to collect the pumped material and also provides points of germination for corrosion and abrasion, etc.

One attempt to overcome these drawbacks has been to bond the stud directly to the diaphragm without passing the stud through the diaphragm, so that a substantially smooth, uninterrupted working face is provided.

One technique for providing such an integrated stud has been to bond the stud directly to the PTFE diaphragm. However, such techniques have generally been unsatisfactory due to the difficulty of forming a secure bond to PTFE. Another approach has been to mold the stud in-situ with the PTFE diaphragm, and subsequently use machining techniques to provide the diaphragm with the requisite physical dimensions. While this approach may be satisfactory when fabricating diaphragms of relatively small sizes, i.e. less than approximately 2 inches (5 cm) in diameter, this approach has generally been undesirable for use with larger sized diaphragms due to the amount of material waste and relatively high manufacturing costs associated with the machining techniques. Moreover, it is generally difficult to produce large thin molded shapes having relatively large surface area and desired material density without cracks.

In a still further approach, in the case of the aforementioned two piece diaphragms, the difficulty associated with bonding a stud directly to PTFE has been circumvented by bonding the stud directly to the non-PTFE (i.e. rubber) layer. While this approach may operate reasonably satisfactorily in some applications, this approach tends to delaminate the rubber layer from the PTFE layer due to the lack of direct bond between the stud and the PTFE layer.

Thus, a need exists for an improved PTFE pump diaphragm and method of manufacture thereof, having an integral stud to eliminate the need for a central through-hole and the potential leak/contamination source generated thereby.

SUMMARY OF THE INVENTION

According to an embodiment of this invention, a diaphragm includes:

- a layer of polytetrafluoroethylene, the layer having a face surface and a backing surface, the face surface adapted to operatively engage a fluid;
- a stud encapsulated with a fluoropolymer, the stud being fastened to the layer and extending substantially orthogonally therefrom, wherein the stud is free of the face surface.

In another aspect of the present invention, a method of fabricating a diaphragm includes the steps of:

(a) providing a stud;

(b) molding the stud in-situ with a first layer of polytetrafluoroethylene to form a pre-mold; and (c) annealing the first layer.

In a third aspect of the present invention, a stud is provided for use in a diaphragm having a layer of polytetrafluoroethylene with a face surface and a backing surface, the face surface being adapted to operatively engage a fluid. The stud includes:

- a rod portion;
- a flange portion disposed at a proximal end of the rod portion;
- a fluoropolymer disposed in encapsulating contact with the flange portion;
- the flange portion adapted for being fastened to the backing surface of the diaphragm, wherein the stud is free of the face surface thereof.

In a further aspect of the invention, a composite diaphragm includes:

- a first layer of polytetrafluoroethylene, the first layer having a face surface and a backing surface, the face surface adapted to operatively engage a fluid;
- a stud fastened to the first layer, extending substantially orthogonally from the backing surface, the stud being free of the face surface; and
- a second layer of a thermoplastic elastomeric blend of a thermoplastic material and a fully vulcanized thermoset elastomer, the second layer being fastened to the backing surface.

In a still further aspect of the invention, a method of fabricating a composite diaphragm includes the steps of:

(a) providing a first layer of polytetrafluoroethylene, the first layer having a face surface and a backing surface, the face surface adapted to operatively engage a fluid;

(b) fastening a stud to the first layer, wherein the stud extends substantially orthogonally from the backing surface, the stud being free of the face surface;

(c) annealing the first layer;

(d) chemically etching a surface of the first layer;

(e) applying an adhesive to the surface of the first layer;

(f) providing a second layer of a thermoplastic elastomer;

(g) disposing the second layer in superposed engagement with the first layer, wherein the adhesive contacts both the backing face of the first layer and the second layer;

(h) applying heat to the superposed first layer and second layer; and (i) applying pressure to the superposed first layer and second layer wherein the first layer is bonded to the second layer to form an integral composite diaphragm.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
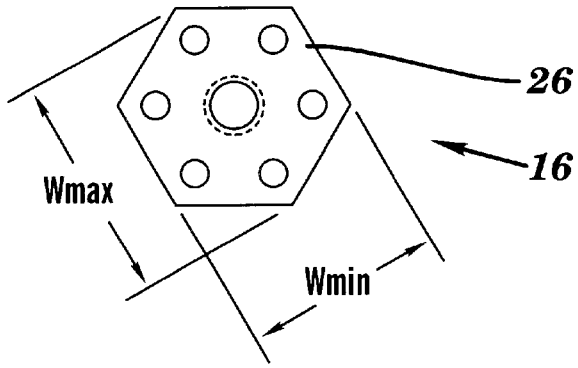
FIG. 1 is a bottom plan view of a flanged stud of the present invention.

Referring to the figures set forth in the accompanying Drawings, the illustrative embodiments of the present invention will be described in detail hereinbelow. For clarity of exposition, like features shown in the accompanying Drawings shall be indicated with like reference numerals. Similar features, such as shown with respect to alternate embodiments of the present invention, shall be indicated with similar reference numerals.

Figure 8:
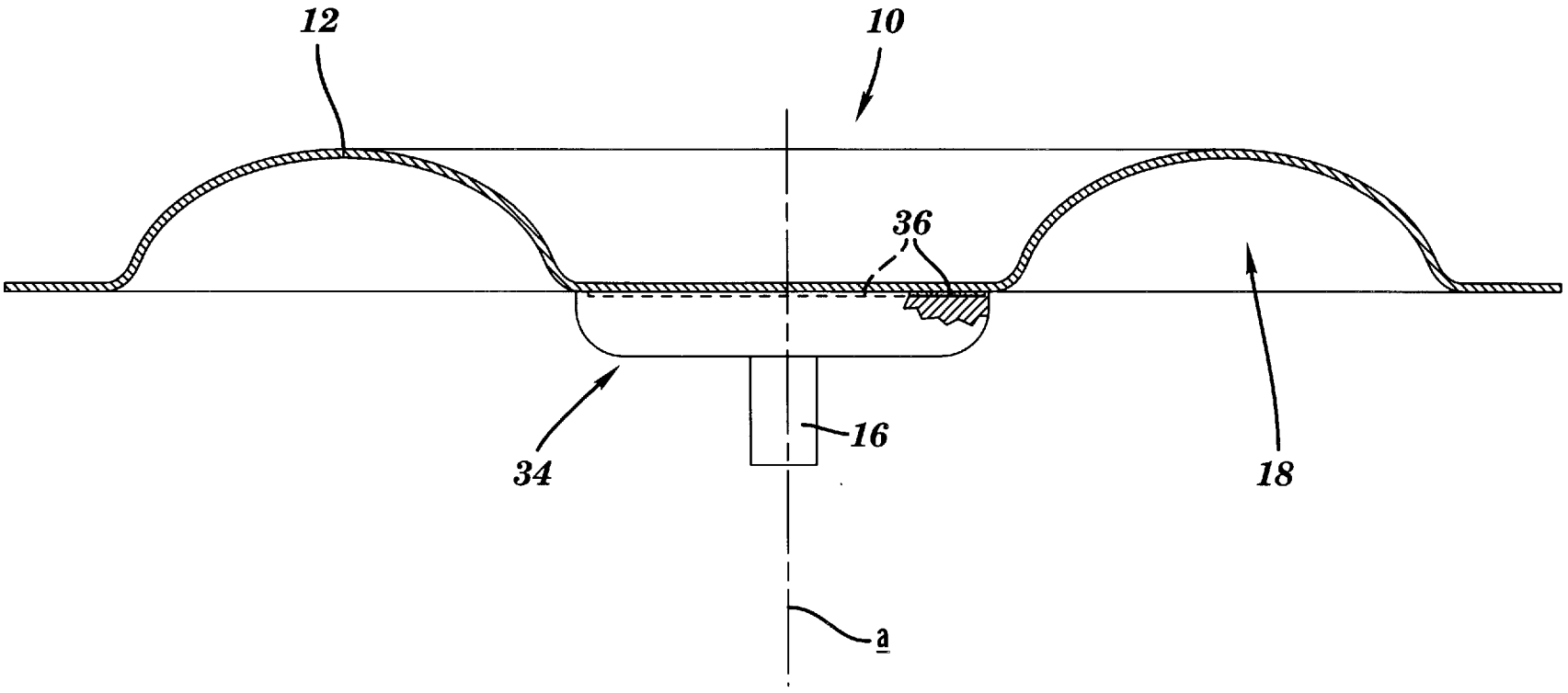
FIG. 8 is an elevational, partially cross-sectional, view, with portions broken away, of a fully assembled embodiment of the present invention.
Figure 10:
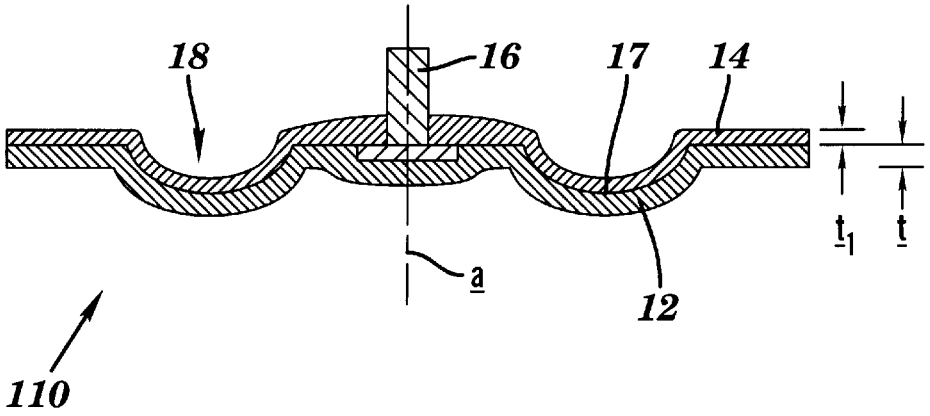
FIG. 10 is an elevational cross-sectional view taken along 10—10 of FIG. 9.

As best shown in FIGS. 8 and 10, an embodiment of the present invention includes a pump diaphragm 10 having a layer 12 fabricated from polytetrafluoroethylene (PTFE) and an integral stud 16. In one embodiment in particular, a portion of the stud 16 is encapsulated within a hub 23 fabricated from PTFE and fastened to the PTFE layer 12 with adhesive or welding, etc., as shown with respect to diaphragm 10 in FIG. 8. In alternate embodiments, the stud (i.e., 16 or 16') may be molded in-situ with the PTFE layer using various methodology, such as shown, for example, with respect to diaphragm 110 in FIG. 10, or by pressing a stud 16' onto a heated PTFE layer as shown with respect to diaphragm 310 in FIGS. 18 and 19 e.g., using plates 44" and 46". PTFE layer 12 then may be subjected to various additional operations to provide the diaphragm with desired dimensions and/or properties. Moreover, as also shown in FIG. 10, an additional layer or layers, such as an elastomeric layer 14, may be laminated onto an inside surface 17 of PTFE layer 12 to provide a composite pump diaphragm 110.

As used herein, the term "axial" shall refer to a direction substantially parallel to central axis a of the diaphragms 10, 110, 210 and 310 of the present invention and components thereof as shown in FIGS. 1, 4, 8, 10, 15 and 18.

Figure 9:
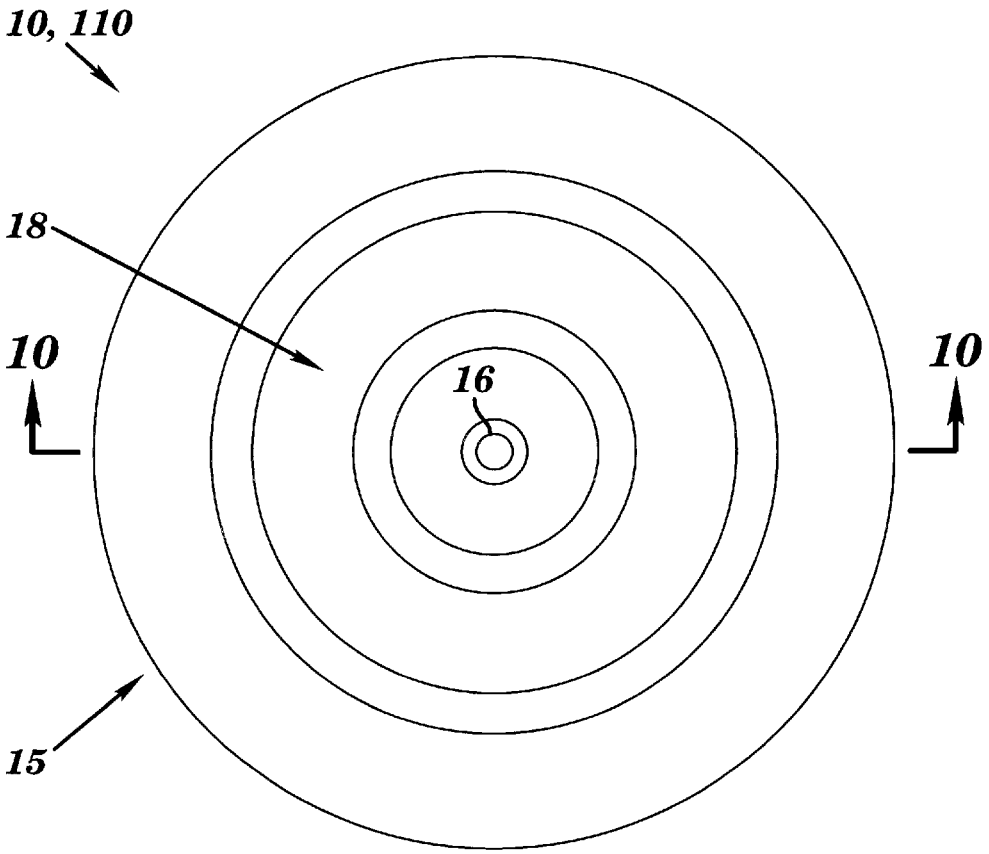
FIG. 9 is a plan view of a fully assembled alternate embodiment of the present invention.

Referring now to the drawings in detail, as shown in FIGS. 8–10, diaphragms 10 and 110 are generally disk shaped devices which may be provided with substantially any geometry desired for a particular pump application. As shown in FIG. 9, the diaphragm has a substantially circular perimeter 15 of predetermined diameter, with a central stud 16 adapted for engagement with a pump (not shown). The diaphragm may also include an annular, concavo-convex flexure or displacement portion 18. This flexure portion 1E of the diaphragm is that portion of the diaphragm which reciprocally flexes as the diaphragm is used. As shown, in various preferred embodiments, the surfaces of PTFE layer 12 are substantially smooth. However, layer 12 (and/or layer 14 if utilized) may be formed with annular or radial ribs as utilized in prior art diaphragms such as disclosed in U.S. Pat. Nos. 4,238,992 (to Tuck, Jr.) and 5,349,896 (to Delaney III, et al.), both of which are fully incorporated by reference herein. Moreover, as shown in FIG. 10, layers 12 and 14 of diaphragm 110 are preferably bonded directly to one another in surface to surface engagement without the use of intermediate reinforcing layers such as fabric and the like. The present invention thus enables use of substantially smooth, unreinforced layers of PTFE and elastomer which are respectively bonded directly to one another in surface to surface engagement, as well as layers having reinforcements, as will be discussed in greater detail hereinbelow. As used herein, the term "smooth" as used in conjunction with a layer of material, means a layer which is not provided with either annular or radially extending ribs. Similarly, the term "unreinforced" as used herein refers to a layer of material which is neither reinforced by ribs, nor by a fabric or cloth material laminated thereto.

Figure 2:
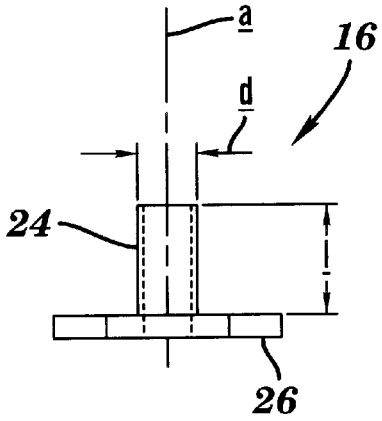
FIG. 2 is an elevational view, with portions shown in phantom, of the flanged stud of FIG. 1.

Turning now to FIGS. 1 and 2, stud 16 includes an elongated rod portion 24 having a disk or flange portion 26 disposed at one end thereof. Rod portion 24 may be provided with external threads 56 (FIGS. 11–12), or may be formed as a hollow cylinder as shown, to facilitate use of threads (not shown) on an internal surface thereof, to fasten the stud 16 to a pump. Alternate configurations of rod portion 24, such as a solid cylinder and/or non cylindrical shapes may be utilized if desired. Rod portion 24 is fastened to disk or flange portion 26 using any convenient attachment means familiar to those skilled in the art, such as welding, brazing, and the like. Moreover, it is contemplated that stud 16 may be formed as an integral unit, such as by molding the rod portion 24 and flange portion 26 as a single unit, or by utilizing conventional flanging techniques to flange one end of rod portion 24 to form a suitable flange portion 26 disposed integrally thereon. Flange 26 may be circular, or as shown in FIG. 1, is preferably provided with a non-circular geometry such as the polygonal (hexagonal) shape as shown. This non-circular geometry helps secure stud 16 to hub 23 (FIG. 5) or to PTFE layer 12 (FIG. 10), to prevent stud 16 from rotating about its central axis a relative to the diaphragm during use and/or installation onto a pump. Stud 16 may be provided with any desired predetermined dimensions. In an exemplary embodiment, rod portion 24 is approximately 0.5 inches (1.3 cm) in diameter d, having a length 1 of approximately 1 inch (2.5 cm), while disk portion 26 is provided with thickness t2 of approximately 0.187 inches (0.5 cm) and a transverse dimension w (orthogonal to axis a) within a range from a $w_{min}$ of approximately 1.75 inches (4.5 cm) to a $w_{max}$ of approximately 2.0 inches (5 cm). A stud 16 may be fabricated from any suitable material such as steel, aluminum, alloys, and various non-metallic materials such as carbon fiber, Kevlar®, nylon (polyamide), ceramics and reinforced and non-reinforced plastics such as PEEK, PAI (polyamideimide), PI (polyimide), composites and combinations thereof.

Figure 3:
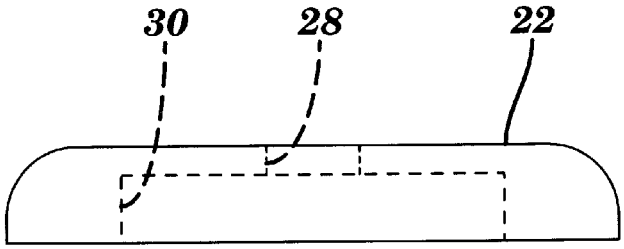
FIG. 3 is an elevational view, with portions shown in phantom, of a PTFE hub of the present invention.

Turning now to FIG. 3, the present invention further comprises a hub housing 22 which is generally disk shaped with a central aperture 28 and recess 30 sized and shaped to receive rod portion 24 and disk portion 26, respectively, therein, with the rod portion 24 extending through aperture 28. Recess 30 is also sized and shaped to receive a backing plate 32 (FIG. 4), in superposed relation with disk portion 26 of the stud 16. This effectively encapsulates disk portion 26 within the hub 23 (FIG. 5). Hub 23, including housing 22 and backing plate 32, are fabricated from a fluoropolymer such as PTFE and/or modified PTFE to facilitate bonding or fastening to PTFE layer 12, as will be discussed hereinbelow. Housing 22 and backing plate 32 may be fabricated using any desirable manufacturing methods, including molding and/or machining techniques known to those skilled in the art.

Figure 4:
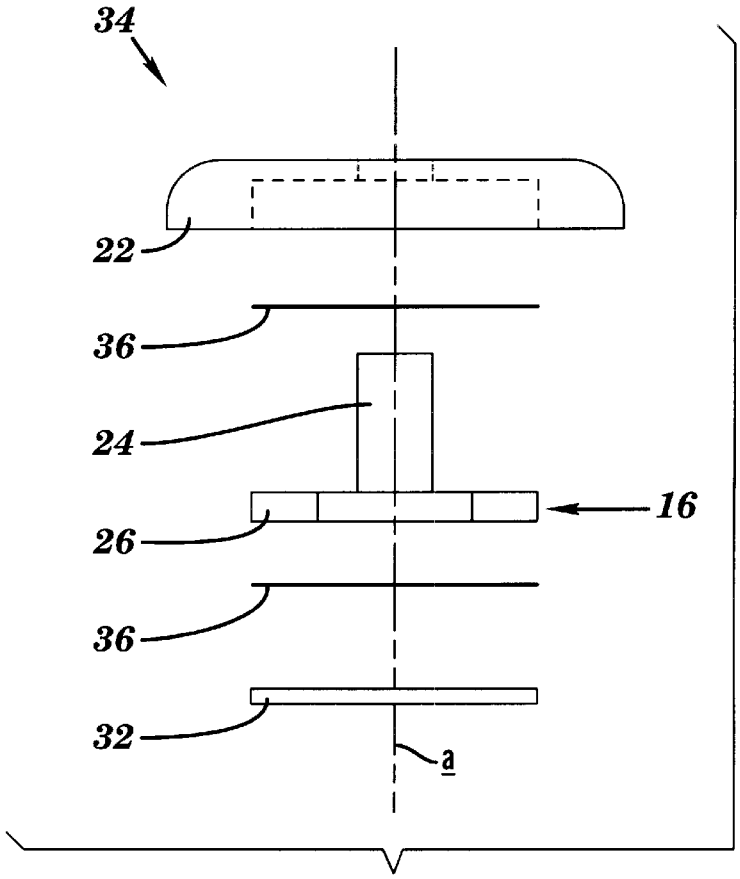
FIG. 4 is an exploded elevational view, with portions shown in phantom, of an assembly of various components of the present invention.
Figure 5:
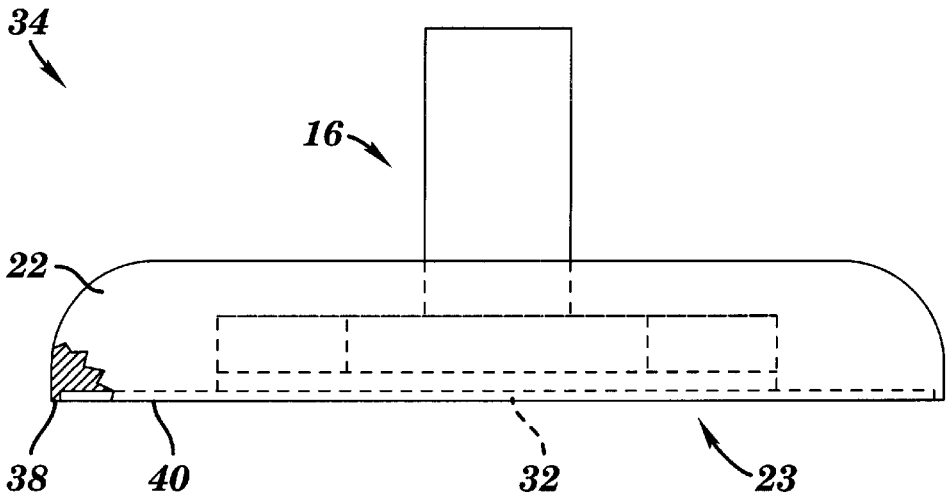
FIG. 5 is an elevational view, with portions shown in phantom, of the assembled components of FIG. 4.

Turning now to FIGS. 4 and 5, the stud 16 is assembled with hub 23 (FIG. 5) to form a stud/hub assembly 34. As shown in FIG. 4, layers of bonding material 36, such as PFA, or other suitable adhesive material, are interposed between mating surfaces of disk portion 26 and housing 22, and between mating surfaces of disk portion 26 and back plate 32. These components are then assembled and maintained under heat and pressure sufficient to cure the bonding material 36 to form the unified stud/hub assembly 34 as shown in FIG. 5. As also shown in FIG. 5, a peripheral lip 38 is formed in hub 23 to provide the hub with a slightly recessed concave surface 40 adapted to retain or capture adhesive therein to facilitate bonding to PTFE layer 12 as will be discussed in greater detail hereinbelow. Lip 38 may be formed by machining the cured stud/hub assembly 34 or alternatively, may be molded integrally with housing 22.

Figure 6:
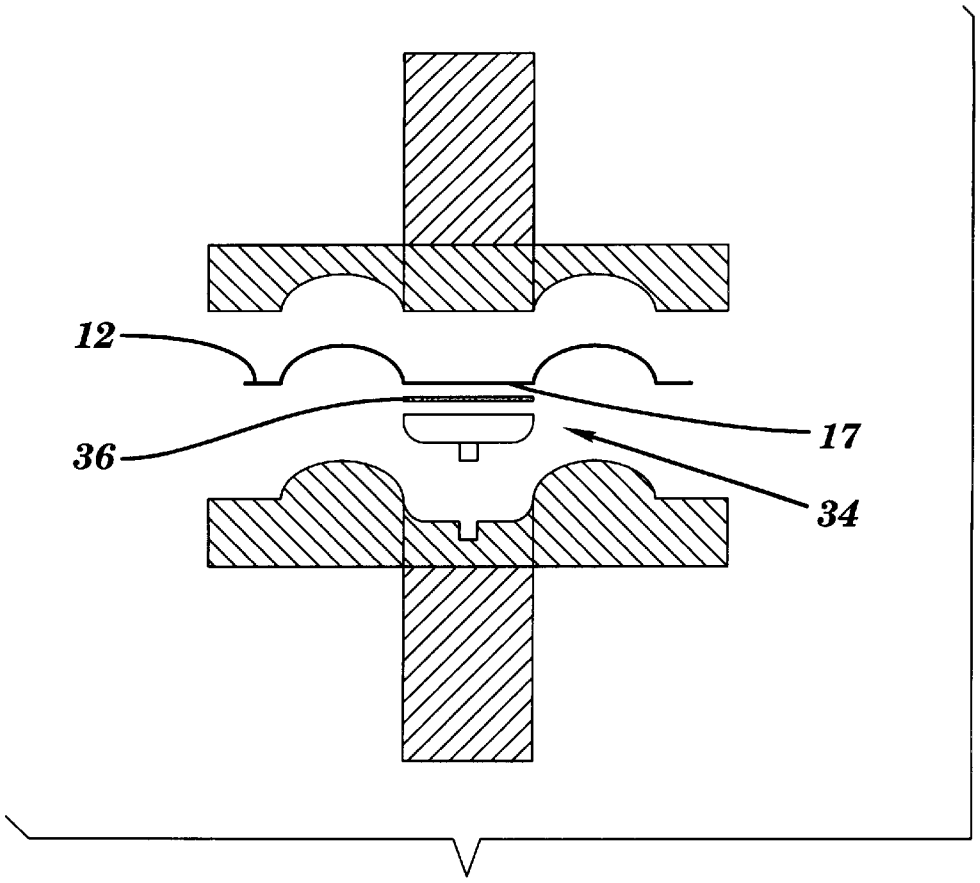
FIG. 6 is an exploded, partially cross-sectional, view of various components of the present invention including the assembly of FIG. 5, during a step in the fabrication of the present invention.
Figure 7:
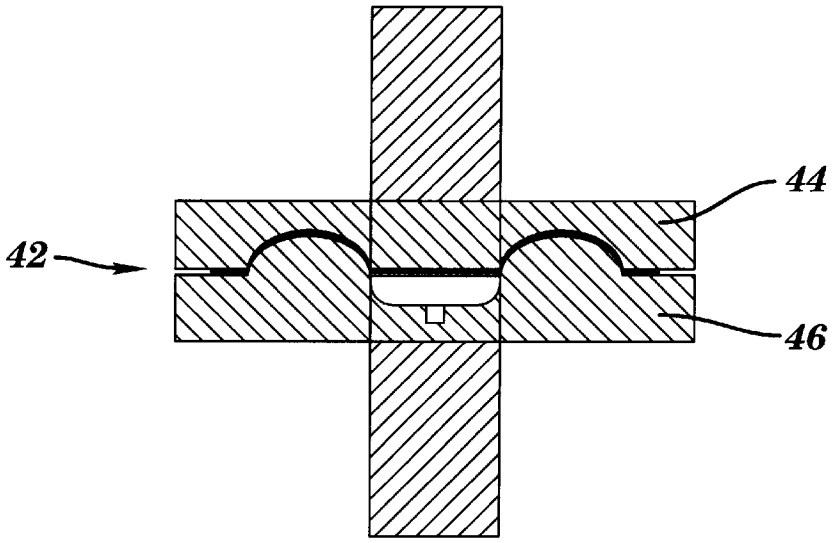
FIG. 7 is an elevational, partially cross-sectional, view of the assembly of FIG. 6 during a subsequent step in the fabrication of the present invention.

Turning now to FIG. 6 stud/hub assembly 34 is fastened to inside (i.e., airside) surface 17 of PTFE diaphragm layer 12. In an exemplary embodiment, PTFE diaphragm 12 may include a conventional diaphragm model number TF 63 available from Norton Performance Plastics Corporation of Elk Grove, Ill. Assembly 34 may be fastened in any suitable manner to diaphragm 12. For example, in the event the assembly 20 is fabricated from modified PTFE (i.e., TFM), the stud/hub assembly 34 may be fastened to surface 17 of layer 12 by welding, i.e. by thermally fusing using heat and pressure. Alternatively, a layer of bonding material 36, such as PFA or similar adhesive material may be applied between recessed surface 40 of assembly 34 and surface 17 of the diaphragm 12, as shown in FIG. 6. The diaphragm and assembly 34 then may be clamped in a suitably sized and shaped mold assembly 42 under pre-determined heat and pressure as shown in FIG. 7. Upper and lower mold platens 44 and 46, respectively, are subsequently cooled to a predetermined quench temperature to complete the bonding procedure to produce a completed diaphragm 10 as shown in FIG. 8. Both of the above-described fastening techniques, i.e. welding and bonding with adhesive 36, advantageously may be accomplished without etching surface 17 of the diaphragm layer 12. Moreover, additional bonding materials such as MFA may be utilized, and a TFM assembly 34 may be welded to diaphragms 12 fabricated from PTFE or modified PTFE (i.e., TFM) or similar fluoropolymers.

Figure 21:
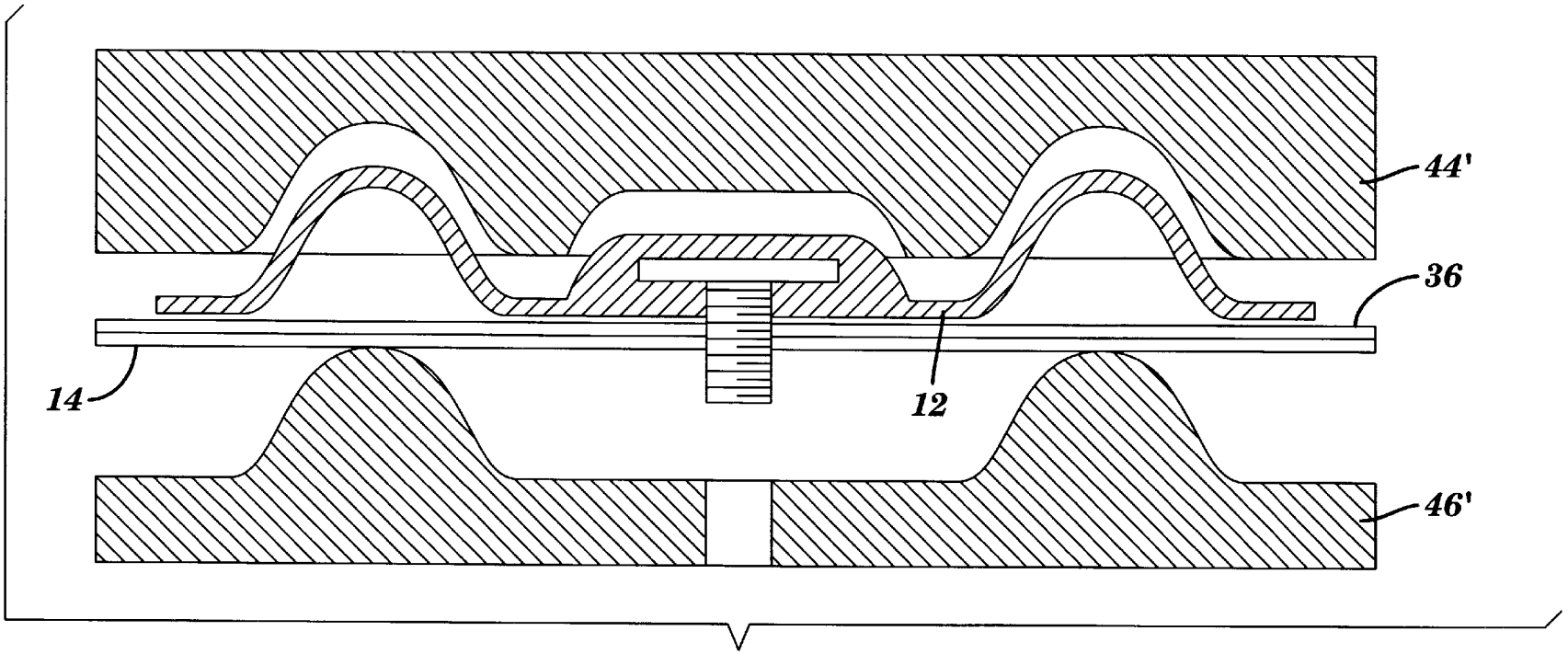
FIG. 21 is an exploded, partially cross-sectional, view of various components of an alternate embodiment of the present invention, during a step in the fabrication of the present invention.
Figure 22:
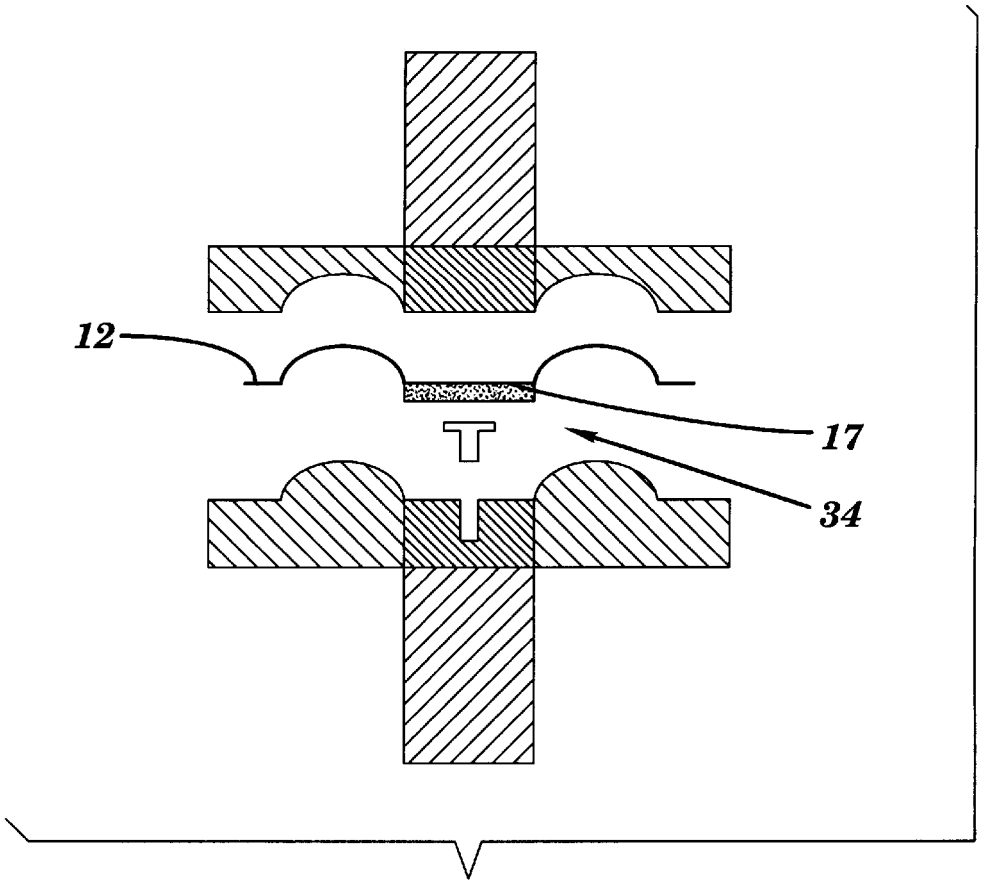
FIG. 22 is an elevational, partially cross-sectional, view of the assembly of FIG. 21 during a subsequent step in the fabrication of the present invention.

In an alternate embodiment, rather than encapsulating stud 16 within hub assembly 20, stud 16 may be molded in-situ within a PTFE or modified PTFE (TFM) diaphragm layer 12 such as shown in FIG. 10. This approach may be utilized to form a diaphragm having a single layer 12 similar to diaphragm 10 of FIG. 8, or in the alternative, one or more additional layers such as layer 14 may be added to form a composite diaphragm 110 such as shown in FIG. 10, and as will be discussed in greater detail hereinbelow. Such PTFE diaphragms with molded-in-place studs may be fabricated by molding stud 16 in the PTFE or similar fluoropolymer material of layer 12, and subsequently machining the PTFE to form the desired diaphragm geometry. This approach is generally acceptable for relatively small diameter diaphragms (i.e., less than about 5 cm), however, as discussed hereinabove, it may generate undesirable amounts of waste material when utilized with relatively larger diameter diaphragms. A preferred method of fabrication according to the present invention is to mold stud 16 in-situ with a sheet of PTFE, such as shown in FIGS. 21 and 22 to form a pre-mold, such as shown at 210 in FIG. 15. This pre-mold is then heat-treated or annealed in the manner set forth in commonly assigned U.S. patent application Ser. No. 09/159,059, (the '059 application) entitled PUMP DIAPHRAGM AND METHOD FOR MAKING THE SAME, which is fully incorporated by reference herein. In this manner, a mold having platens of pre-determined configuration such as shown in FIG. 6 and 7, may be utilized to heat the PTFE material to its gel point and provide the material with the desired geometry, including concavo-convex displacement portion 18. The material is then quenched under pressure which serves to modify the crystalline structure of the PTFE to provide a diaphragm of desired geometry and flex life. The resulting diaphragm may be utilized in applications similar to those for which diaphragm 10 (FIG. 8) may be utilized.

Figure 20:
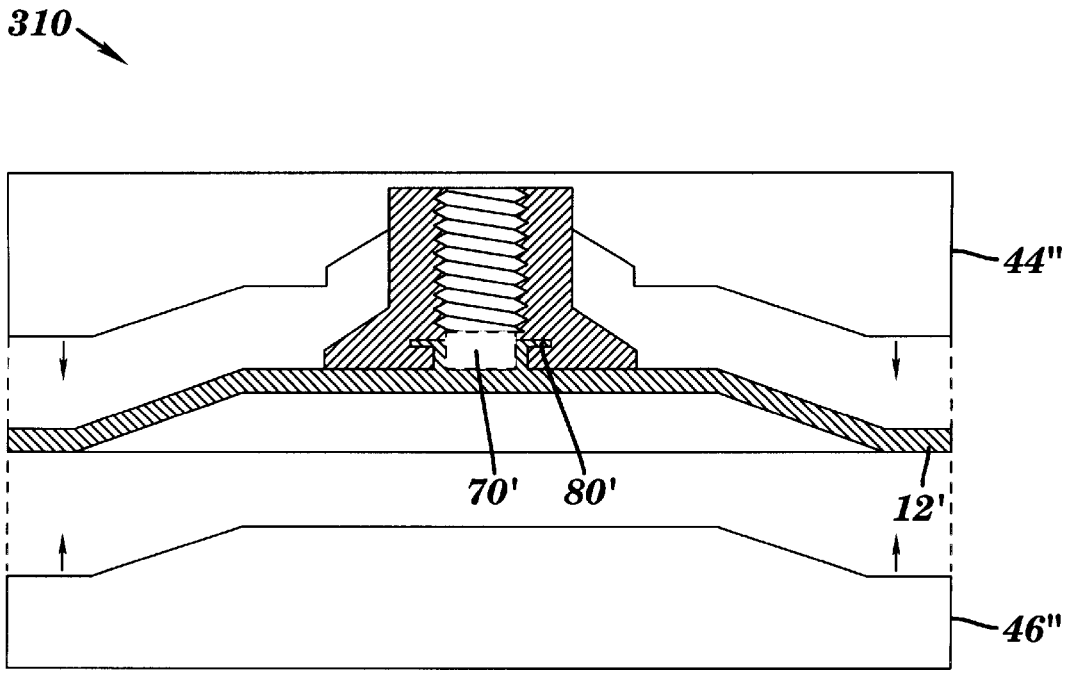
FIG. 20 is an elevational view, with portions shown in cross-section, during steps in the fabrication of an embodiment of the present invention.

In a further alternative, as mentioned hereinabove, the PTFE diaphragm with molded in-situ stud 16 may be provided with an additional layer 14 of a desired material. For example, layer 14 may include a thermoplastic elastomer applied to inside surface 17 of PTFE layer 12 as shown in FIG. 10, in the manner described in the above-referenced '059 application, e.g., by applying heat and pressure using heated platens 44' and 46' as shown in FIG. 20, and optionally quenching, such as further shown and described with respect to FIGS. 7–8.

A preferred method for bonding layer 14 to PTFE layer 12, as disclosed in the above-referenced '059 application, includes etching the inside surface 17 of layer 12 with a suitable chemical etchant to increase the surface energy of the PTFE and thereby increase its adherence to the layer 14. Examples of suitable etchants include alkali napthanates or ammonianates such as sodium ammonianate and sodium napthalene. The ammonianates are preferred etchants for use in the present invention as they have been shown to provide a better bond than the napthanates.

After etching, a bonding agent is applied to the etched surface to the PTFE layer 12. A preferred bonding agent is a mixture of 2 weight percent of amino silane monomer in methyl isobutyl ketone (MIBK) such as sold under the trademark Chemlock® 487B by Lord Corporation of Erie, Pa.

Layer 14 may be substantially any thermoplastic elastomer, (thermoplastic rubber) such as styrene-butadiene block copolymers (YSBR), styrene-isoprene rubber (YSIR), vinylacetate-ethylene copolymers (YEAM), polyolefins (YEPM) and YAU, YEU and YACM. In a preferred embodiment, layer 14 is fabricated from a thermoplastic elastomeric blend of a thermoplastic material such as a thermoplastic polyolefin resin and a fully cured or vulcanized thermoset elastomer such as a vulcanized monoolefin co-polymer rubber. Such a material is disclosed in U.S. Pat. No. 4,130,535.

For example, the thermoplastic elastomer may include a blend of about 25 to 85 parts by weight of crystalline thermoplastic polyolefin resin and about 75 to about 15 parts by weight of vulcanized monoolefin copolymer rubber. In a more specific example, the resin is polypropylene and the rubber is EPDM rubber, in the proportions of about 25–75 parts by weight of polypropylene and about 75–25 parts by weight of EPDM rubber.

An example of such a thermoplastic rubber is a blend of EPDM (ethylene-propylene terpolymer) and a polypropylene sold under the trademark Santoprene® registered to Monsanto Company and exclusively licensed to Advanced Elastomer Systems, L. P., of St. Louis, Mo. Santoprene® thermoplastic rubber is available in several grades ranging from a durometer or hardness of 55 Shore A to 50 Shore D, having flexural moduli ranging from between 7 and 350 MPa as set forth in a technical bulletin entitled Santoprene® Thermoplastic Rubber, published by Advanced Elastomer Systems, L. P. and which is fully incorporated by reference herein. Preferred grades of Santoprene® thermoplastic rubber for use in the present invention range from a durometer of 73 Shore A to 40 Shore D, having flexural moduli ranging from 24 to 140 MPa, respectively.

The thermoplastic layer 14 is mated in a superimposed manner with the etched and adhesive coated inside surface 17 of PTFE layer 12. Heat and pressure are then applied to the superimposed layers 12 and 14 to bond the layers to one another. The layers are preferably heated to a temperature which is near or within the conventional melt processing range of the layer 14 to facilitate forming and bonding of the material. For example, where a Santoprene® thermoplastic rubber having a melt processing temperature of about 380 degrees F. (193 degrees C.) is used, the layers 12 and 14 are heated to a temperature of approximately 375 to 385 degrees F. (190 degrees C. to 196 degrees C.) under pressure of approximately 250–500 psi (1.7–35 MPa).

The application of heat and pressure may be accomplished by clamping the layers between heated platens of a clamp or press such as shown as 44 and 46 in FIG. 7. In a similar alternative, the layers may be heated followed by compression in an unheated clamp or press.

Moreover, in a preferred embodiment, layer 14 may be formed by injection molding the thermoplastic rubber onto the etched and adhesive coated PTFE layer 12. This approach is particularly advantageous as it tends to provide a laminant of consistent quality nominally without air bubbles which are generally problematic in other heat/pressure formed laminates. The present invention facilitates use of this injection molding technique by its ability to provide adequate performance without fabric or similar reinforcements, since such reinforcement tends to complicate the injection molding process.

As shown, the completed diaphragm 10 may be provided with any suitable physical dimensions, with PTFE layer 12 having a thickness $\underline{t}$ (FIG. 2) and thermoplastic layer 14 having a thickness $\underline{t}\,\underline{1}$. Diaphragms 10 formed as described hereinabove have been shown to be resistant to cracking and delamination. As discussed hereinabove and as shown, preferred embodiments of the present invention have substantially smooth surfaces. However, as discussed hereinabove, the diaphragms of the invention may be provided with radially, concentrically or otherwise oriented ribs or other reinforcement such as fabric, fibers, etc., as taught in the prior art.

Advantageously, the composite or laminated diaphragm 110 of the present invention captures stud 16 within the PTFE layer 12 rather than within the elastomeric layer 14. This approach tends to transfer pumping force directly to the PTFE layer 12 and thus does not rely on the bonding and integrity of elastomeric layer 14 to retain the stud. This construction provides improved diaphragm life relative to studded diaphragms in which the studs are captured within the elastomeric portion of the laminate.

Figure 11:
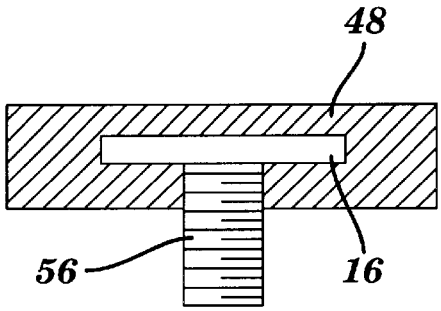
FIG. 11 is an elevational, partially cross-sectional view of a portion of an alternate embodiment of the present invention during a step in the fabrication thereof.
Figure 12:
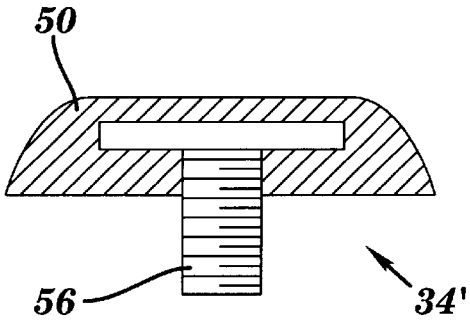
FIG. 12 is a view similar to that of FIG. 11, of the portion during a subsequent step in the fabrication thereof.
Figure 13:
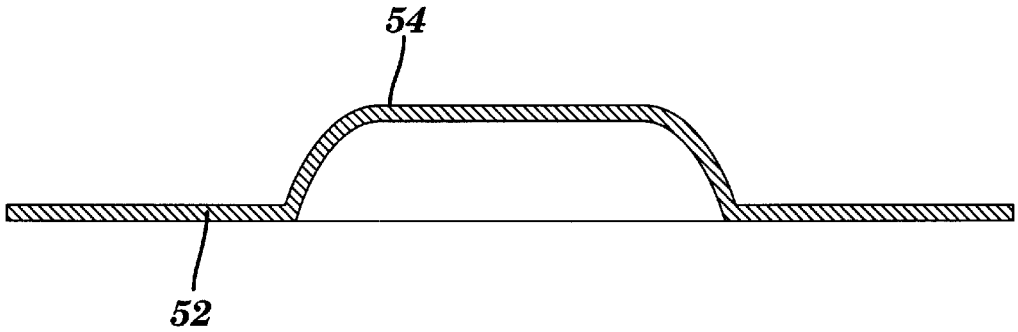
FIG. 13 is an elevational cross-sectional view of an other component of the present invention, adapted for engagement with the component of FIG. 12.

Variations of the above-described embodiments may also be utilized. For example, in an additional embodiment of the present invention, a stud 16 may be insert molded within a block of modified PTFE (i.e., TFM) 48 as shown in FIG. 11. Block 48 then may be machined to provide a substantially convex surface 50 to form the stud/hub assembly 34' as shown in FIG. 12. In a preferred embodiment, block 48 may be molded with the convex surface 50 during the insert molding step, to effectively provide hub/stud assembly 34' in a single process step to nominally eliminate the need for a discreet machining operation. Turning to FIG. 13, a layer 12' (FIG. 17) is fabricated by first providing a sheet 52 of modified PTFE formed to have a central concavo-convex portion 54 sized and shaped to receivably engage convex surface 50 of hub/stud assembly 34' therein. Sheet 52 may include a skived sheet, a sheet sliced from a billet or a sheet formed in any other conventional manner. The concavo-convex portion 54 may be cold formed or formed by heating either the sheet 52 or by utilizing conventional heated tools, as will be familiar to those skilled in the art.

Figure 14:
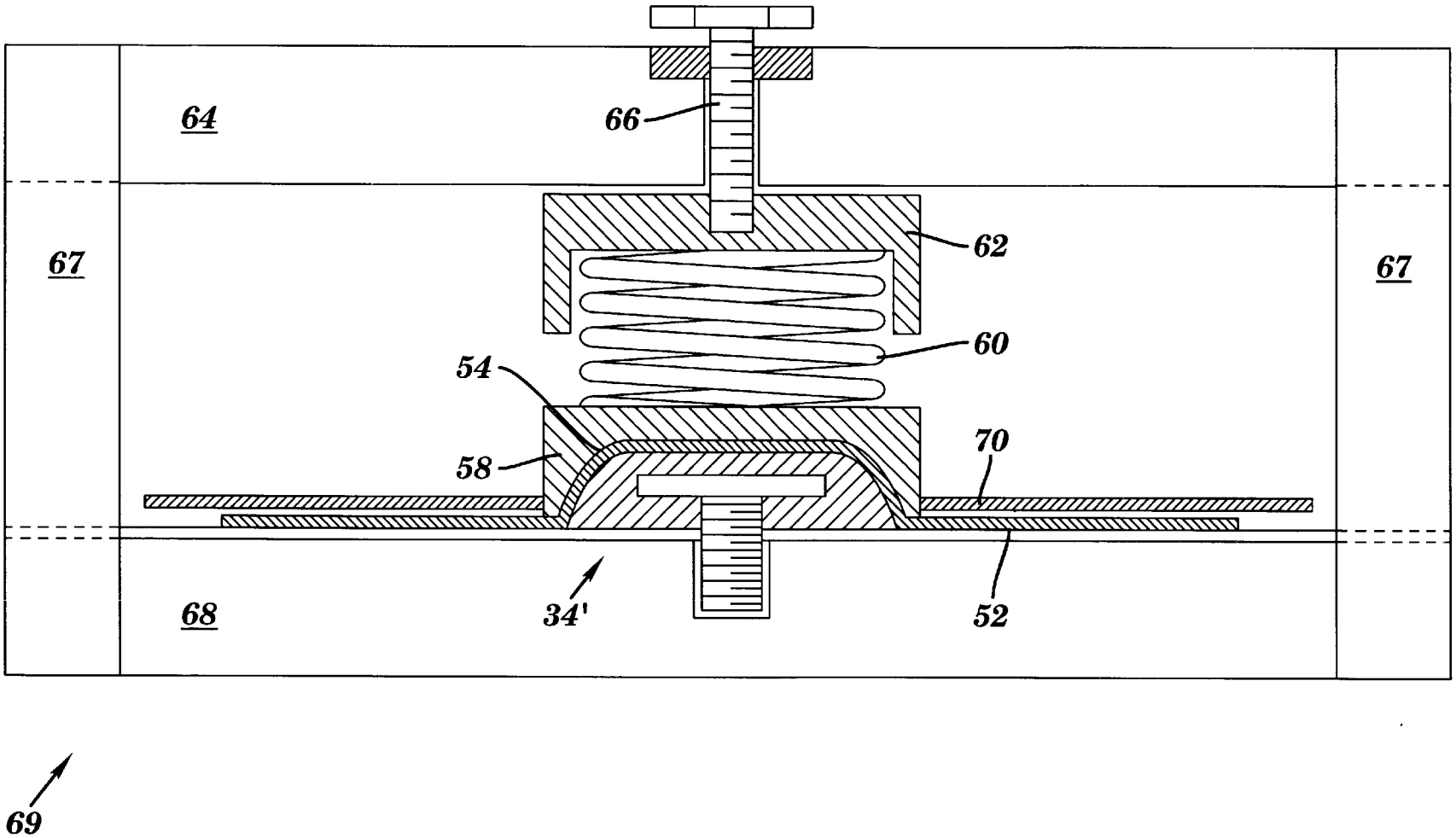
FIG. 14 is an elevational view, with portions shown in cross-section, of the components of FIGS. 12 and 13, during a subsequent step in the fabrication thereof.

Turning now to FIG. 14, hub/stud assembly 34' is receivably engaged by the concavo-convex portion 54 of sheet 52 and placed into a welding fixture 69 which serves to maintain the assembly 34' in axially compressive engagement with sheet 52. In this regard, a hub pressure plate 58 sized and shaped to receivably engage the concavo-convex portion 54 of sheet 52 is releasably biased into engagement with the concavo-convex portion 54 by a spring 60. The spring 60 is in turn supported by a support 62 adjustably mounted to a frame member 64 such as by use of a threaded adjustment bolt 66. The upper frame rail 64 is removably fastened in any convenient manner to side and base members 67 and 68 to form the integrated welding fixture 69. Bolt 66 operates in a conventional manner to facilitate adjustment of the pressure exerted on pressure plate 58 by the spring 60. The spring 60 is utilized to maintain the concavo-convex portion 54 in axial, compressive contact with hub/stud assembly 34', while allowing for thermal expansion of the modified PTFE during welding. A rigid sheet 69 (preferably fabricated from a metallic material such as steel) is superimposed with the sheet 52 radially outward of the concavo-convex portion 54 to help prevent the sheet 52 from curling or becoming otherwise deformed during the welding process. The components in contact with the modified PTFE, such as the plate 69, hub/pressure plate 58, and frame member 68, are preferably coated with a bond inhibiting material such as nickel plating, to substantially inhibit bonding between the modified PTFE and the metallic components. Those skilled in the art will recognize that various alternate bond inhibiting materials other than nickel plating and the like, may be utilized, particularly in the event pressure plate 58 and/or other PTFE-engaging components such as plate 69, etc. are fabricated from a non-metallic material such a ceramic or similar material.

Figure 15:
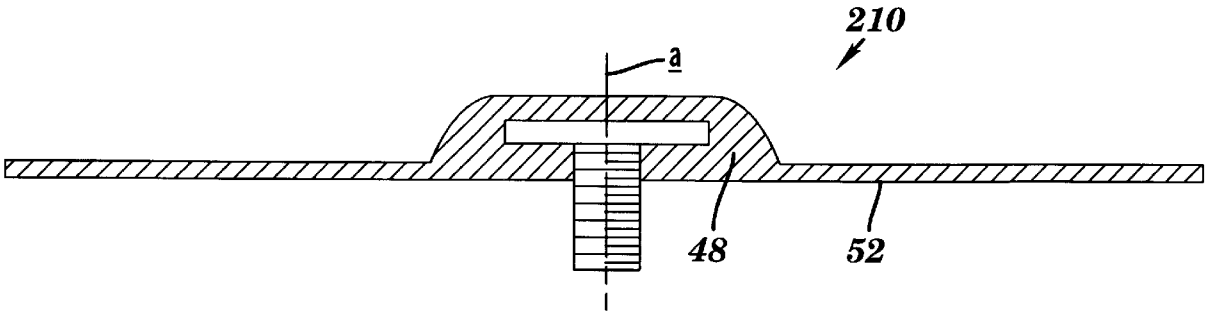
FIG. 15 is a view similar to that of FIG. 14, of components of the present invention, upon completion of the step of FIG. 14.

The sheet 52 and assembly 34' is heated, such as by placing the fixture 69 into an oven, to, or above, the gel point of the modified PTFE to weld the sheet to the assembly 34'. The welded modified PTFE components are then cured utilizing curing cycles common to those skilled in the art of PTFE molding. Upon completion of the welding and curing cycles, block 48 of assembly 34' is substantially homogeneous with the sheet 52, as shown in FIG. 15. Such homogeneity may provide substantially greater strength than adhesively fastened components.

Figure 16:
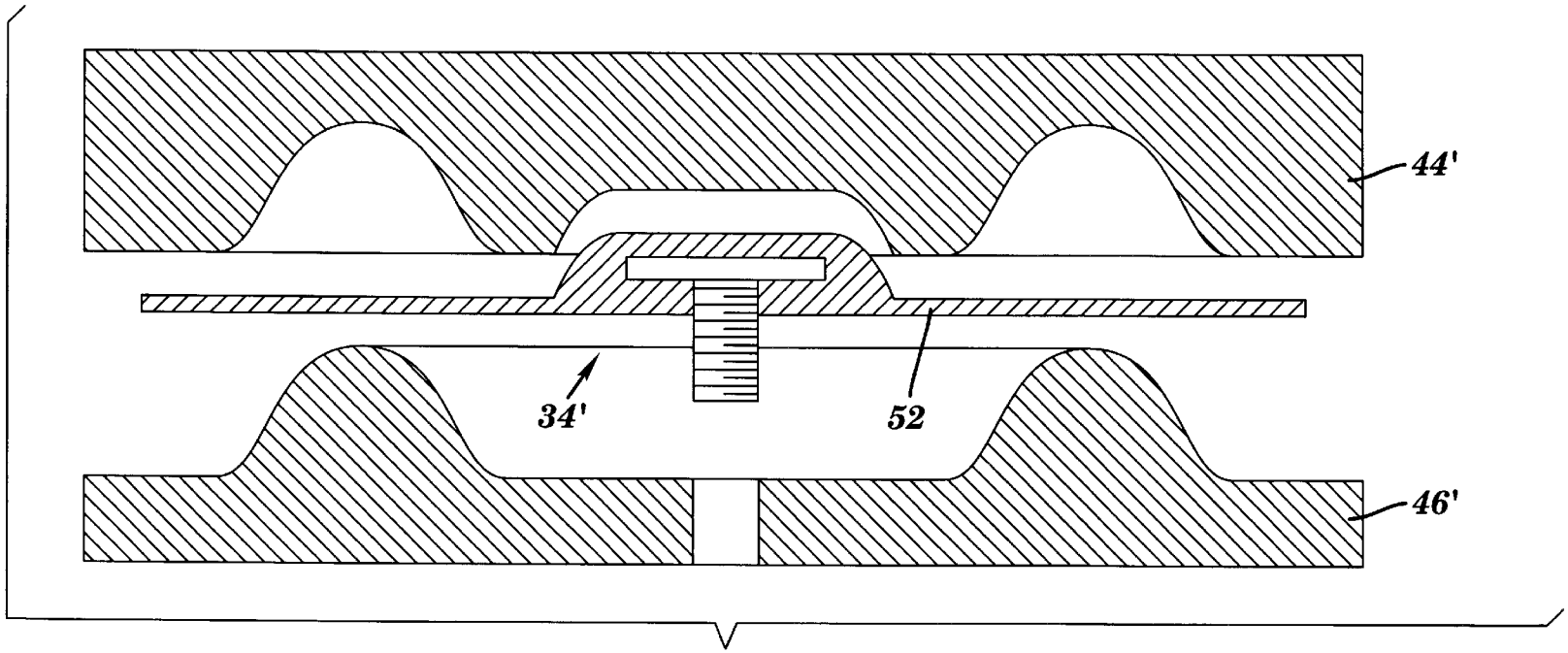
FIG. 16 is a view similar to that of FIG. 15, during a still further step in the fabrication thereof.
Figure 17:
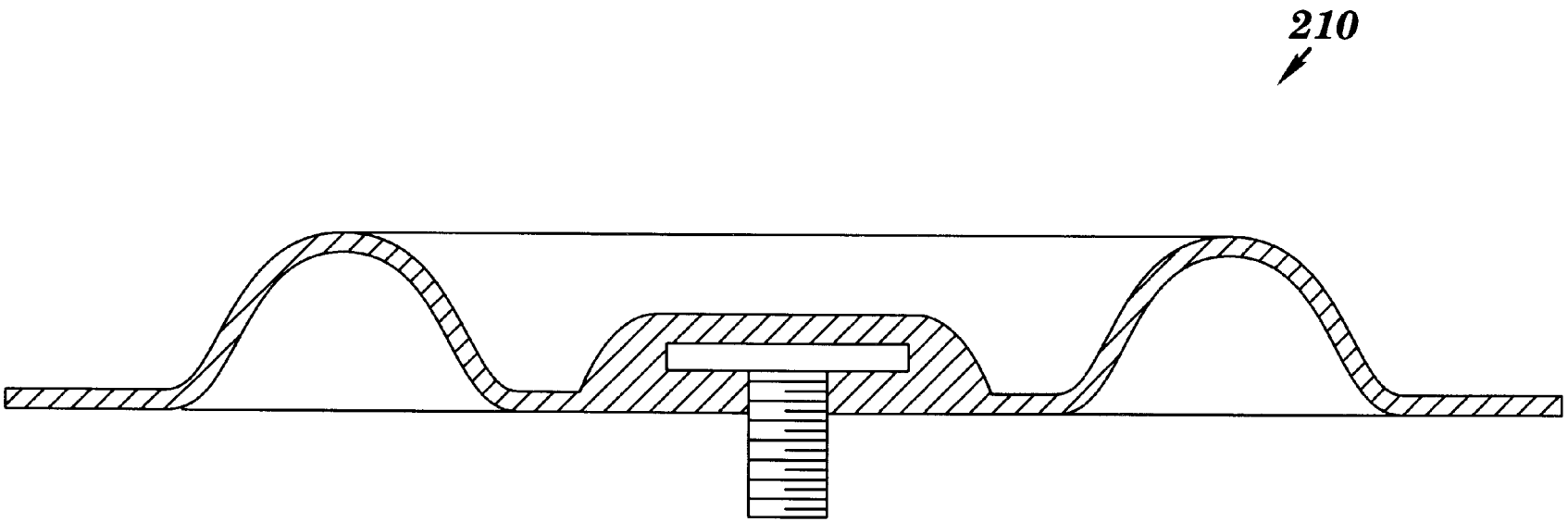
FIG. 17 is an elevational, partially cross-sectional view of a completed diaphragm formed as shown in FIGS. 12–16.

As shown in FIG. 16, the assembly of FIG. 15 may be subsequently placed between mold platens 44' and 46' sized and shaped to provide sheet 52 with flexure portions 18 (FIG. 17) as discussed hereinabove. The assembly of FIG. 15 is then annealed by heating to about the gel point of the modified PTFE, and then molding the assembly with platens 44' and 46' to form the flexure portions 18, and then quenching. In this manner, the crystallinity of the modified PTFE is reduced to provide improved cycle life as discussed hereinabove with respect to FIGS. 6 and 7. The resulting diaphragm 210 including layer 12' and integral stud 16 is shown in FIG. 17. As discussed hereinabove with respect to FIG. 10, additional layers 14 (FIG. 10) may be superposed with layer 12' in still further embodiments of the present invention.

Figure 18:
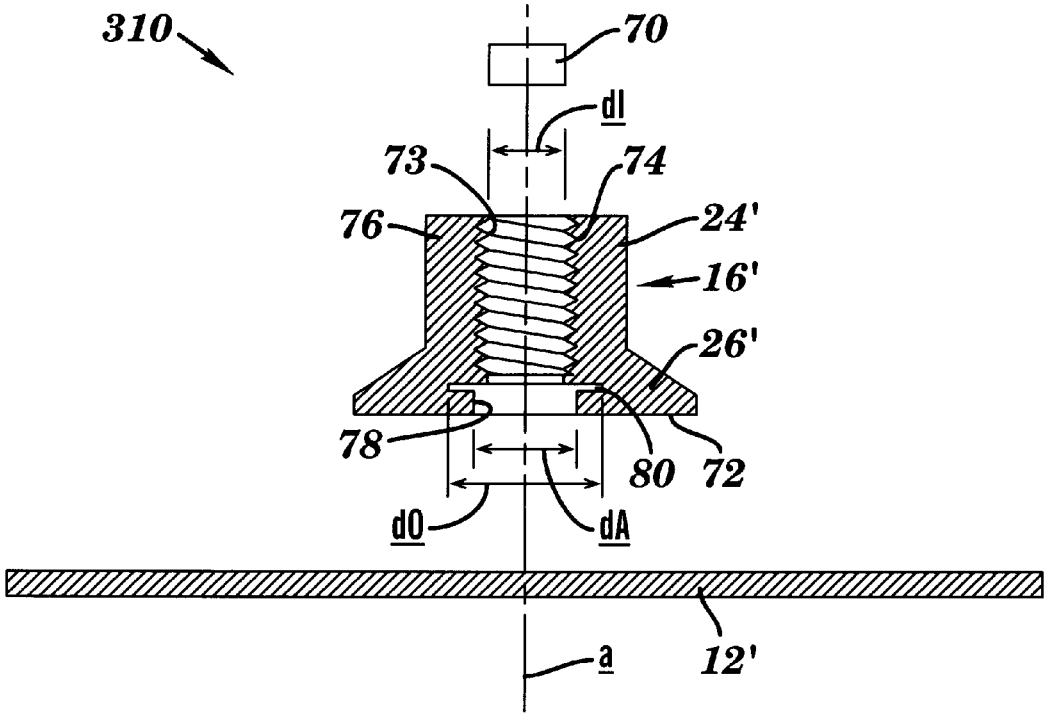
FIG. 18 is an elevational, exploded view, with portions shown in cross-section, of an alternate embodiment of the present invention.
Figure 19:
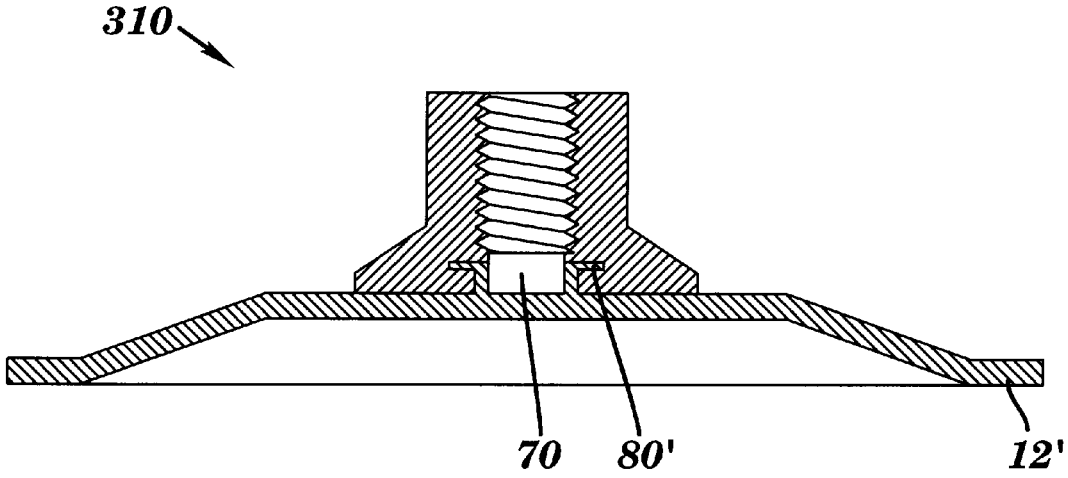
FIG. 19 is an elevational view, with portions shown in cross-section or in phantom, of the fully assembled embodiment of FIG. 18.

In a still further embodiment, an alternate approach for attaching (i.e., molding in-situ) a stud to a PTFE diaphragm of the present invention is shown in FIGS. 18 and 19. Turning to FIG. 18, a studded diaphragm 310 is fabricated from a PTFE sheet 12', a stud (also referred to as an insert) 16' and optionally, a plug 70. Sheet 12' is substantially similar to sheet 12 described above.

As shown, the stud 16' includes a rod portion 24' having a disk or flange portion 26' disposed at a proximal end thereof. Flange portion 26' includes a mating surface 72 adapted for surface to surface engagement with a portion of the sheet 12' as will be discussed hereinbelow. Stud 16' is preferably fabricated with a central bore 73 which extends therethrough from a distal end 76 to an aperture 78 disposed in mating surface 72. The bore 73 is preferably provided with interior threads 74 (shown schematically) which extend a predetermined distance from the distal end 76 thereof, for attachment to a pump (not shown). The portion of bore 73 disposed between the threaded portion and the aperture 78 is provided with a stepped diameter to form a recess or undercut 80 having an outer diameter dO greater than the diameter dI of the threaded portion of the bore 73 and greater than the diameter dA of aperture 78. As shown, diameter dA of the aperture 78 is also preferably greater than diameter dI of bore 73 to facilitate interlocked engagement with layer 12' as discussed hereinbelow.

Stud 16' may be fabricated from any suitable material, such as metal, or preferably from a polymeric material (i.e., a thermoplastic), as also will be discussed in greater detail hereinbelow. Plug 70 may be fabricated from any suitable material, such as metal or a polymer.

Turning to FIG. 19, the plug 70 is sized and shaped for an interference fit within the bore 73, while extending axially into recess 80. The plug 70 is preferably sized and shaped to extend sufficiently into the recess 80 so that a surface of the plug 70 is disposed nominally flush with surface 72 of the insert 16' as shown. In this orientation, shown as plug 70, the plug serves to effectively close a central portion of recess 80 to reduce the interior volume thereof to form an annular cavity 80'. The plug 70, 70' is conveniently utilized to enable the stud/insert 16' to be fabricated by conventional machining processes. One skilled in the art should recognize, however, that the stud 16' may be fabricated by various alternative methods, such as, for example, investment casting or molding, in which plug 70 is formed integrally therewith.

Once the plug 70 is disposed therein, as at 70', the stud 16' is placed in a die on a platen of a press of a conventional press such as shown and described hereinabove with respect to FIGS. 6 and/or 14. The platens of the press are preferably maintained at a predetermined temperature (i.e., the quench temperature) as discussed hereinabove, such as by conventional water cooling. The sheet 12' is heated to about its gel temperature and inserted into the die. The platens are then moved toward one another to close the die, to move the PTFE sheet into the annular recess 80'. The relatively cool temperature of the platens serves to solidify the PTFE to effectively form an interlocked or dovetailed arrangement to lock the stud 16' to the sheet 12' to form the diaphragm 310. Moreover, the platens may be maintained at the quenching temperature, so that the layer 12' is effectively quenched during the attachment (i.e., molding) operation. In this manner, the diaphragm 310 may be annealed and quenched during the process of the molding the stud in-situ with the layer 12'.

Moreover, in a modification of this embodiment, during molding, plug 70 may be replaced with a similarly shaped, but smaller diameter pin (not shown). For example, the pin may be integrated into the cavity of the die to extend axially through bore 73 and into recess 80 of the stud 16' (i.e., into the general position occupied by plug 70 as shown in FIG. 19). After molding, the pin may be replaced with plug 70. The relatively larger diameter of the plug 70 will tend to form a tight fit (i.e., an interference fit) with the sheet material formerly engaged with the pin, to provide an enhanced mechanical engagement between the sheet 12' and the stud 16'.

Although the recess 80 and 80' is formed by walls which generally diverge from aperture 78, the skilled artisan should recognize that the recess may be provided with substantially any geometry capable of forming an interlocking engagement with a portion of the layer 12' disposed therein. For example, the walls may be wavy or generally sinusoidal, or otherwise extend obliquely relative to the axial direction, such as may be provided by fabricating recess 80' as a plurality of bores extending divergently into the stud 16' from surface 72.

The diaphragm 310 may be utilized as so formed, or may be subjected to further processing steps, such as to provide flexure portions 18, provide additional layers 14, or to further anneal the PTFE layer as discussed hereinabove.

Advantageously, the stud 16' of this embodiment is maintained at relatively cool temperatures by the cooled platens and is exposed to the relatively high temperature gel-state PTFE for only a relatively short period of time. This approach thus effectively molds the stud 16' in-situ with the PTFE layer 12' without subjecting the the stud 16' to the relatively high temperatures associated with the gel state of PTFE. This enables the stud 16' (and/or plug 70) to be fabricated from materials having relatively low temperature resistance, such as thermoplastics as mentioned hereinabove, for ease of manufacture and/or material cost savings. Also, the use of the recessed stud 16' of this embodiment requires relatively little movement (flow) of the PTFE layer 12' during forming (molding) to provide the interlocked engagement. The use of plug 70, 70' further reduces the volume of PTFE required to flow into the recess to form the interlock. Such relatively little PTFE flow advantageously permits such engagement by heating only to the PTFE gel point (i.e., about 326 to 332 degrees C.), rather than to higher temperatures utilized for conventional molding operations. Also, this embodiment enables standard PTFE sheet stock to be utilized to further simplify the manufacturing process.

Figure 23:
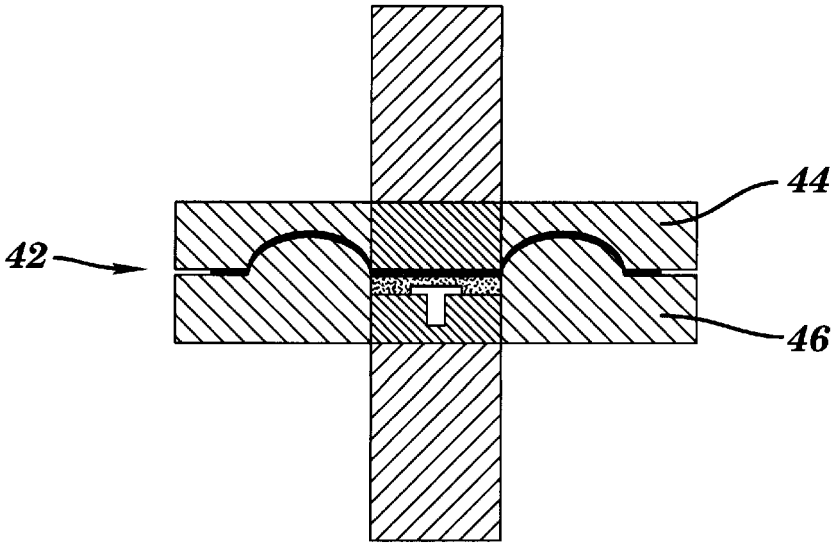
FIGS. 23–26 are block diagrammatic flow charts of process steps in the methods of fabrication of the present invention, with optional steps shown in phantom.

Turning now to FIG. 23, a method 400 of fabricating a diaphragm of the present invention includes the steps of providing 401 a stud, molding 402 the stud in-situ with a block of modified polytetrafluoroethylene (TFM), welding 404 the block to a first layer of TFM, and 406 annealing the first layer. Optionally, the welding step 404 may include the step of 408 heating the modified polytetrafluoroethylene to at least its gel point while applying axial pressure to the block and first layer. The annealing step 406 may optionally include the steps of heating 410 the first layer to at least its gel point, and quenching 412 the first layer. An additional optional step includes applying 414 a second layer of a thermoplastic elastomer in superposed engagement with the first layer.

Figure 24:
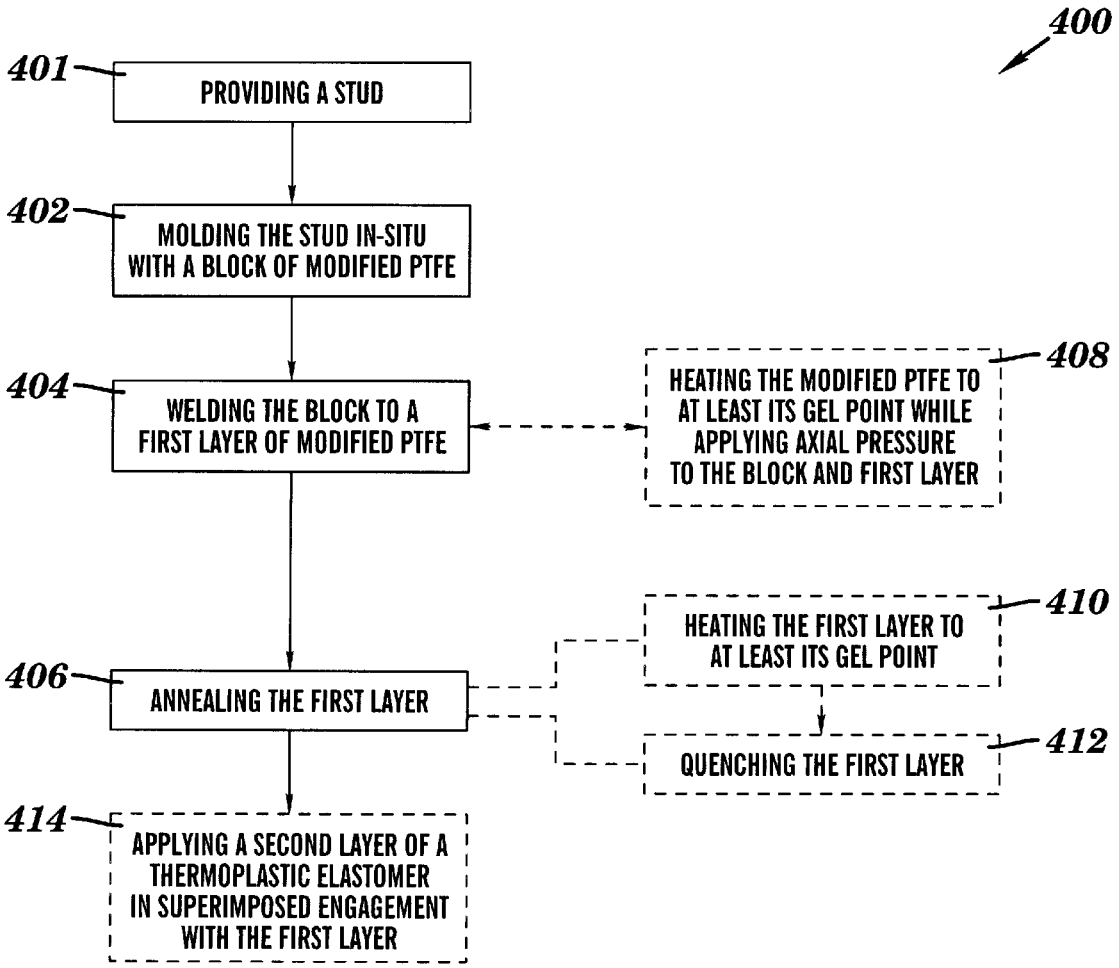

Turning to FIG. 24, an alternate method of fabricating a diaphragm of the present invention includes the steps of providing 401 a stud, molding 502 the stud in-situ with a first layer of polytetrafluoroethylene to form a pre-mold, annealing 406 the first layer, and injection molding 514 a second layer onto the first layer. Optionally, the annealing step 406 may include steps 410 and 412.

Optionally, method 500 may include the steps of chemically etching 520 a surface of the first layer, and applying 522 an adhesive to the surface of the first layer. In addition, the injection molding step 514 may include the optional steps of providing 516 a second layer of a thermoplastic elastomer, disposing 518 the second layer in superposed engagement with the first layer, wherein the adhesive contacts both the first layer and the second layer, applying heat 520 to the superposed first layer and second layer, and applying pressure 522 to the superposed first layer and second layer wherein the first layer is bonded to the second layer to form an integral composite diaphragm.

Figure 25:
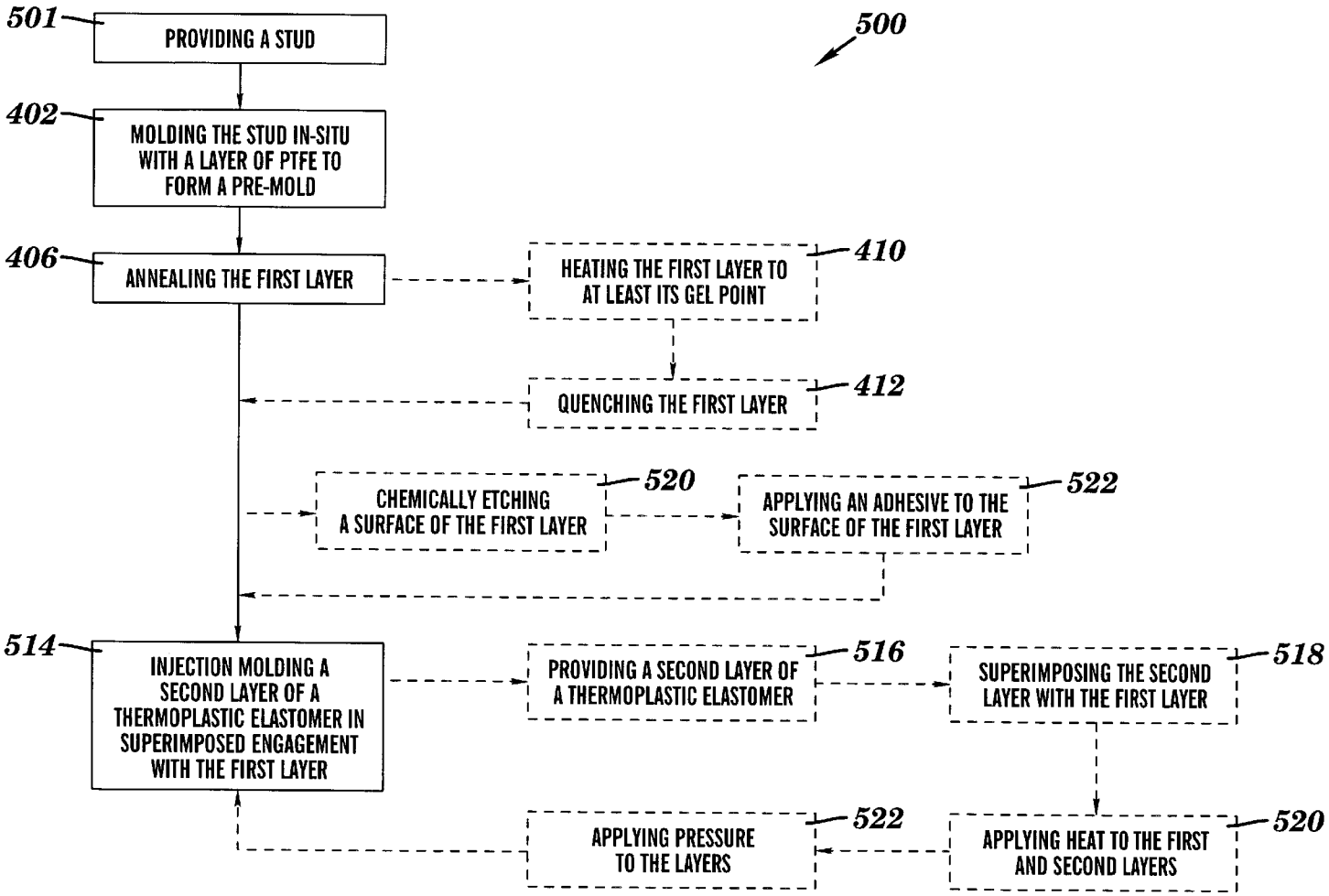

As shown in FIG. 25, in a further embodiment, a method 600 of fabricating a composite diaphragm of the present invention includes the steps of providing 601 a first layer of polytetrafluoroethylene, the first layer having a face surface and a backing surface, the face surface adapted to operatively engage a fluid, fastening 602 a stud to the first layer, extending substantially orthogonally from the backing surface, the stud being free of the face surface, annealing 406 the first layer, including heating 410 and quenching 412. Additional steps include the aforementioned chemically etching 520, applying adhesive 522, providing a second layer 516, superposing the layers 518, applying heat 520, and applying pressure 522 steps.

Figure 26:
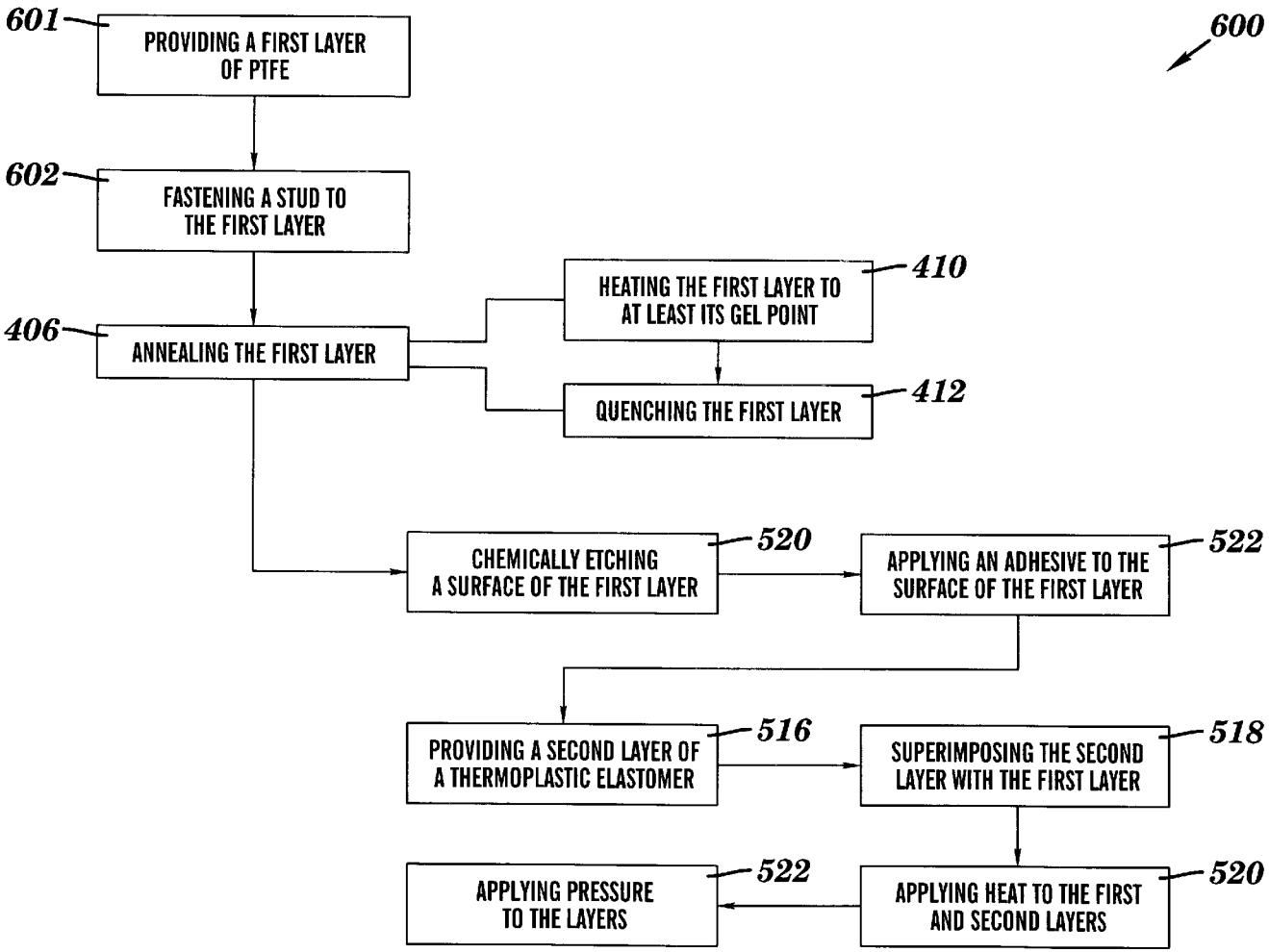
Figure 27:
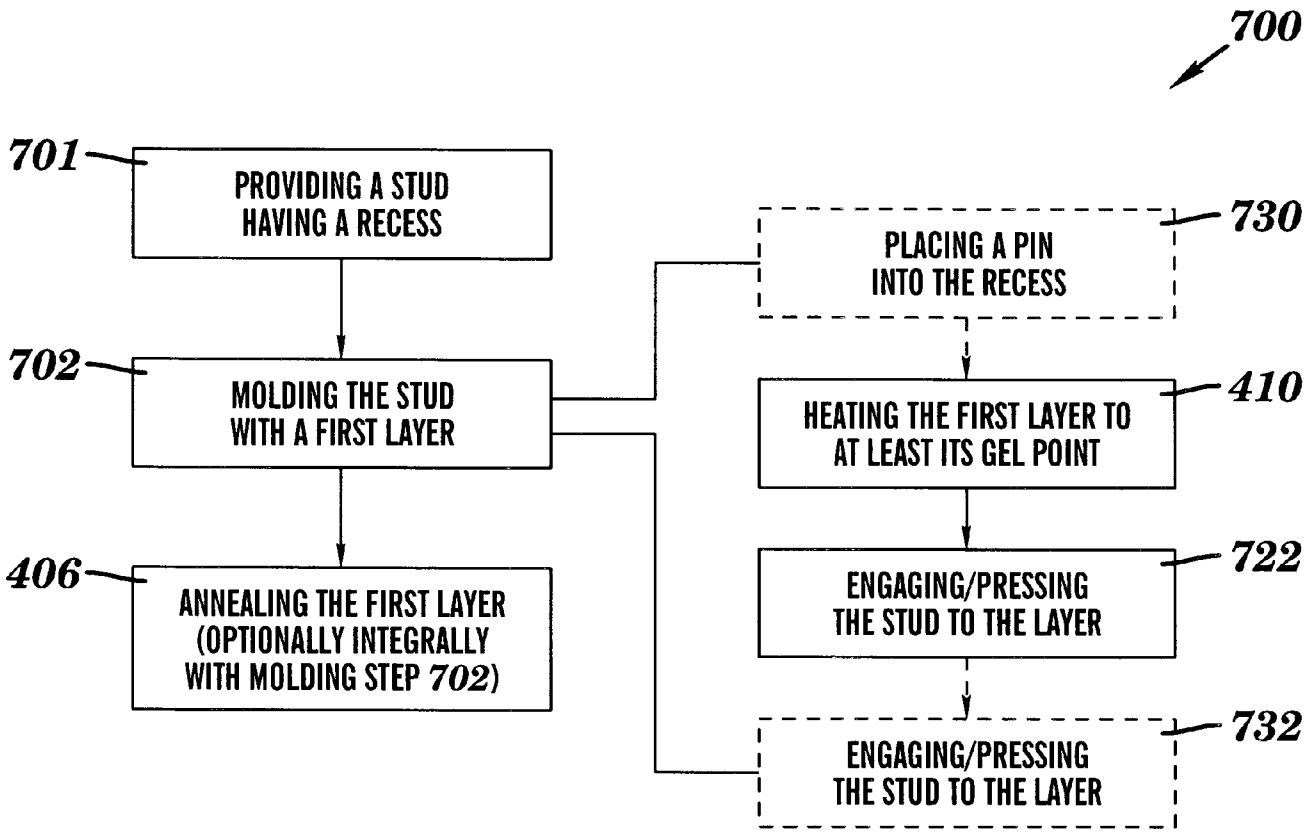

Turning now to FIG. 26, a still further embodiment includes a method 700 of fabricating a diaphragm, and a diaphragm fabricated thereby, including the steps of providing 701 a stud having a recess disposed therein (such as stud 16') molding 702 the stud in-situ with a first layer of polytetrafluoroethylene to form a pre-mold, the molding step 702 including optionally placing 730 a pin into the recess, heating 410 a portion of the first layer to its gel point and engaging/pressing 722 a portion of the first layer into the recess, and annealing 406.

Optionally, the annealing step 406 may be performed integrally with said molding step 702 by utilizing cooled platens to press the heated portion of the first layer into the recess. In the event placing step 730 is used, the pin may be replaced 732 with a plug 70, 70', wherein the plug forms an interference fit with the layer to mechanically interlock said stud with said layer.

As shown and described hereinabove, the pump diaphragms of the present invention are provided with a smooth fluid side surface without a through hole extending therethrough to substantially eliminate crevices associated therewith for improved leak, contamination and corrosion resistance relative to the prior art.

The following illustrative examples are intended to demonstrate certain aspects of the present invention. It is to be understood that these examples should not be construed, as limiting.

EXAMPLES

Example 1

A diaphragm 10 was fabricated substantially as shown in FIGS. 1–8, with a perimeter 15 having a diameter of 10 inches (25.4 cm), a PTFE layer 12 having a thickness t within a range of about 0.030 to 0.060 inches (0.07 to 0.15 cm) and a PTFE hub 22 having an outer diameter (OD) of 3.3 inches (8.4 cm), a recess 30 having a diameter d of 2 inches (5 cm) and a central aperture having a diameter of 0.5 inches (1.3 cm) and a backing plate 32 of ⅛ inch (0.3 cm) thickness sized to be press fit within recess 30. An approximately 0.005 inches (0.01 cm) thick layer of PFA was applied between the stud 16 and hub 22 and a 0.015 inch (0.04 cm) thick layer of PFA was provided between the stud and the backing plate 32. The entire assembly 34 was subjected to an axial pressure of approximately 10 pounds per square inch at approximately 710 degrees F. for approximately 1.5 hours. The recessed surface 40 of hub assembly 20 was covered with a 0.020 inch (0.05 cm) film of PFA and then applied to the air side of a TF 63 PTFE diaphragm. The entire assembly was then place into a mold having centrally disposed hub clamps and diaphragm platens. The hub clamps applied a pressure of approximately 500 pounds per square inch to the hub assembly and co-terminus mating portion of the diaphragm 12, at a temperature of approximately 710 degrees F. (377 degrees C.). The remainder of the diaphragm 12 was maintained at an axial pressure of 50 pounds per square inch, (0.35 MPa) at a temperature of approximately 72 degrees F. (22 degrees C.). The resulting diaphragm 10 was tested in a pumping application in which water was pumped at approximately 100 psi (0.7 MPa) inlet air pressure and 50 psi (0.035 Mpa) water outlet backpressure at a cycle rate of approximately 100 cycles per minute. The diaphragm operated for at least 10 million cycles with no detachment of the stud from the diaphragm.

Example 2 (Control)

A diaphragm is fabricated substantially as described in Example 1, utilizing a layer 12 fabricated from TFM. This diaphragm is tested substantially as described in Example 1 and is expected to complete at least 10 million cycles without detachment of stud 16 from the layer 12 and without rupture of the layer.

Example 3

A diaphragm is fabricated substantially as described in Example 1, with the exception that hub assembly 20 is fabricated from TFM and the hub assembly is fastened to layer 12 by welding. This diaphragm is tested in actual pumping conditions substantially as described in Example 1 and is expected to complete at least 10 million cycles without detachment of the stud from the diaphragm or rupture of the layer 12.

Example 4

A diaphragm is fabricated substantially as shown in FIGS. 9 and 10, except for the omission of layer 14. The diaphragm has a diameter of 7.75 inches (20 cm), with PTFE layer 12 having a thickness t within a range of about 0.2–0.4 inches (0.5–1.0 cm) and a metallic stud 16 formed substantially as shown in FIGS. 1 and 2, having a rod portion 24 of a diameter d of approximately 0.5 inches (1.3 cm) and a flange portion 26 having a thickness of about 0.187 inches (0.5 cm). The diaphragm is formed by molding the flange portion 26 of stud 16 in-situ with a sheet of PTFE. The PTFE sheet with the molded in-situ stud 16 is heated to 700 degrees F. (371 degrees C.) until the PTFE is fully gelled. The PTFE is then quenched in a mold having desired geometry, at 65 degrees F. (18 degrees C.) and an axial pressure of about 300 psi (2.0 MPa). The diaphragm is then allowed to cure at an ambient temperature for 24 hours. The resulting diaphragm is tested in a pumping application substantially as described in Example 1, and is expected to operate for at least 10 million cycles with no rupture of the PTFE layer 12 or detachment of the stud 16 from layer 12.

Example 5

A diaphragm 10 was fabricated substantially as shown in FIGS. 9 and 10, with a perimeter 15 having a diameter of 7.75 inches (20 cm), a PTFE layer 12 having a thickness t within a range of about 0.02 to 0.04 inches (0.5 to 1.0 mm) and a Santoprene® thermoplastic rubber layer 14 having a thickness t1 of 0.130 inches (0.33 cm). A stud 16 substantially as described in Example 4 is molded in-situ in a sheet of PTFE which was subsequently heated and quenched in the manner described in Example 4 to provide a fully formed PTFE layer 12. The layer 12 was then etched and coated with Chemlock 487B and mated with layer 14. The layers 12 and 14 were heated from 350 to 400 degrees F. (176–204 degrees C.), maintained at this temperature for between 2 and 10 minutes, and axially compressed at between 500–750 psi (3.4 and 5.2 MPa). The diaphragm was then allowed to cure at an ambient temperature for 24 hours. The resulting diaphragm 10 was tested in a pumping application in which water within a range of from 105 to 112 degrees F. was pumped at between 96 and 102 psi (0.66 and 0.70 Mpa) at a cycle rate of 340 to 375 cycles per minute. The diaphragm operated for 15 million cycles with no rupture of the PTFE layer or detachment of the stud 16 from layer 12.

Example 6

A diaphragm 10 was fabricated substantially as shown in FIGS. 9 and 10, with perimeter 17 having a diameter of approximately 8.125 inches (20.6 cm), PTFE layer 12 having a thickness t of 0.030 inches (0.7 mm), and Santoprene® layer 14 having a thickness of 0.110 inches (0.28 cm). A stud 16 substantially as described in Example 4, is molded in-situ in a sheet of PTFE which was subsequently heated and quenched in the manner described in Example 4, to provide a fully formed PTFE layer 12. The layer 12 was then etched with sodium ammonianate and coated with Chemlock 487B. A layer 14 was then injection molded onto layer 12 at a temperature within a range of about 375 to 385 degrees F. (190 degrees C. to 196 degrees C.) at a conventional injection molding pressure. The layers were cured at an ambient temperature for 24 hours. This diaphragm was tested in actual pumping conditions substantially as described in Example 1 and completed 15 million cycles without rupture of the PTFE layer.

Example 7

Four diaphragms were fabricated substantially as described in Example 6, utilizing black and naturally pigmented Santoprene® materials of Shore 73A, 80A and 87A hardnesses (i.e. Santoprene® 101-73A, 101-80A, 101-87A, 201-73A, 201-80A and 201-87A, respectively). These diaphragms were tested in actual pumping conditions substantially as described in Example 1 and completed at least 15,000,000 cycles without rupture of the PTFE layer.

Example 8

Two diaphragms 10 were fabricated substantially as described in Example 6, with a layer 14 fabricated from Santoprene® 203-40D (naturally pigmented with a hardness of 40 Shore D) and 271-40D (food grade material with a hardness of 40 Shore D). These diaphragms were tested in actual pumping conditions substantially as described in Example 1 and completed at least 20,000,000 cycles with no rupture of the PTFE layer.

Example 9

A diaphragm 10 is fabricated substantially as described in Example 6 with a perimeter 17 having a diameter of approximately 12 inches (30.5 cm). This diaphragm is expected to complete at least 10,000,000 cycles in actual pumping conditions without rupture of the PTFE layer.

Example 10

A diaphragm 210 was fabricated substantially as shown in FIGS. 11–17, utilizing a modified PTFE known as Dyneon TFM 1600 and having a perimeter 17 of approximately 20 cm, a thickness t of about 1 mm and a thickness t 2 of approximately 5 mm. A stud 16 was molded in-situ with a modified PTFE block 48 according to parameters substantially as described in example 4. The diaphragm was subsequently quenched substantially as described in example 4. This diaphragm operated successfully for over 5,000,000 cycles with no detachment of the stud from the diaphragm.

Example 11

A diaphragm 310 was fabricated substantially as shown in FIGS. 18 and 19, utilizing a PTFE layer 12' and an insert 16'. The insert was machined from metal stock and provided with an axial dimension of 0.356 in (0.904 cm), a bore diameter dI of 0.135 in (0.343 cm), an annular recess diameter dO of 0.276 in (0.701 cm). The axial distance between the recess and mating surface 72 was 0.025 in (0.063 cm) and the axial depth of the threads in the bore was 0.247 in (0.627 cm). The plug 70 had a diameter of 0.1355 in (0.3442 cm) and an axial dimension of 0.065 in (0.165 cm). The PTFE layer had a thickness t of about 1 cm. The stud 16' was fastened to the PTFE layer using a press substantially as described with respect to FIGS. 18 and 19. This diaphragm operated successfully for over 5,000,000 cycles with no detachment of the stud from the diaphragm.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A diaphragm comprising:

a layer of polytetrafluoroethylene, said layer having a face surface and a backing surface, said face surface adapted to operatively engage a fluid;

a stud encapsulated within a hub fabricated from a fluoropolymer, said hub being fastened to said layer and extending substantially orthogonally therefrom, wherein said stud is free of said face surface.

2. The diaphragm of claim 1, wherein said stud is encapsulated with polytetrafluoroethylene and fastened to said backing surface with adhesive.

3. The diaphragm of claim 1, wherein said stud is encapsulated with modified polytetrafluoroethylene and fastened to said backing surface by welding.

4. The diaphragm of claim 1, wherein said stud further comprises a rod portion and a flange portion disposed at a proximal end of said rod portion, wherein said flange portion is encapsulated.

5. The diaphragm of claim 4, wherein said flange portion is encapsulated within the hub, said rod portion extending through an aperture disposed within said hub.

6. The diaphragm of claim 5, wherein said hub is formed by molding and said flange is encapsulated by molding said flange portion in-situ with said hub.

7. The diaphragm of claim 6, wherein said hub is welded to said backing surface.

8. The diaphragm of claim 7, wherein said layer is annealed.

9. The diaphragm of claim 7, wherein thermoplastic elastomer is disposed in superposed engagement with said layer.

10. The diaphragm of claim 5, wherein said hub comprises a plurality of portions adapted to be fastened to one another to encapsulate said flange portion.

11. The diaphragm of claim 10, further comprising:

said hub having said aperture disposed therein, and having a recess adapted to receive said flange portion therein; and a backing plate adapted to close said recess to seal said flange within said recess.

12. A method of fabricating a diaphragm comprising the steps of:

(a) providing a stud;

(b) molding the stud in-situ with a block of modified polytetrafluoroethylene;

(c) welding the block to a first layer of modified polytetrafluoroethylene; and (d) annealing the first layer.

13. The method of claim 12, wherein said welding step (c) further comprises heating the modified polytetrafluoroethylene to at least its gel point while applying axial pressure to the block and first layer.

14. The method of claim 13, wherein said annealing step (d) further the comprises the steps of:

(e) heating the first layer to at least its gel point; and (f) quenching the first layer.

15. The method of claim 12, further comprising the step of applying a second layer of a thermoplastic elastomer in superposed engagement with the first layer.

16. A method of fabricating a diaphragm comprising the steps of:

(a) providing a stud;

(b) molding the stud in-situ with a first layer of polytetrafluoroethylene to form a pre-mold; and (c) annealing the first layer; and (d) injection molding a second layer onto the first layer.

17. The method of claim 16, wherein said annealing step (c) further comprises the steps of:

(e) heating the first layer to its gel point;

(f) quenching the first layer.

18. The method of claim 16, wherein after said annealing step (c) the first layer has a specific gravity less than or equal to 2.15.

19. The method of claim 16, further comprising the steps of:

(f) chemically etching a surface of the first layer;

(g) applying an adhesive to the surface of the first layer;

(h) implementing said injection molding step (d) by providing a second layer of a thermoplastic elastomer, and disposing the second layer in superposed engagement with the first layer, wherein the adhesive contacts both the first layer and the second layer;

(i) applying heat to the superposed first layer and second layer; and (j) applying pressure to the superposed first layer and second layer wherein the first layer is bonded to the second layer to form an integral composite diaphragm.

20. The method of claim 19, wherein the thermoplastic elastomer comprises a blend of a thermoplastic material and a fully vulcanized thermoset elastomer.

21. The method of claim 20, wherein the thermoplastic elastomer further comprises a blend of about 25 to 85 parts by weight of crystalline thermoplastic polyolefin resin and about 75 to about 15 parts by weight of vulcanized monoolefin copolymer rubber.

22. The diaphragm of claim 16, wherein said layer has a transverse dimension of at least about 5 cm.

23. A stud for use in a diaphragm including a layer of polytetrafluoroethylene with a face surface and a backing surface, the face surface being adapted to operatively engage a fluid, the stud comprising:

a rod portion;

a flange portion disposed at a proximal end of said rod portion;

a fluoropolymer disposed in encapsulating contact with said flange portion;

said flange portion adapted for being fastened to the backing surface of the diaphragm, wherein said stud is free of the face surface thereof.

24. The stud of claim 23, wherein said flange portion is encapsulated with polytetrafluoroethylene and adapted for being fastened to the backing surface with adhesive.

25. The stud of claim 23, wherein said flange portion is encapsulated with modified polytetrafluoroethylene and adapted for being fastened to the backing surface by welding.

26. The stud of claim 23, wherein said flange portion is encapsulated within a disk, said rod portion extending through an aperture disposed within said disk.

27. The stud of claim 26, wherein said flange is encapsulated by molding said flange portion in-situ with said disk.

28. The stud of claim 27, wherein said disk further comprises:

a hub having a recess adapted to receive said flange portion therein, the aperture extending through said hub in communication with the recess; and a backing plate adapted to close said recess to encapsulate said flange within said recess.

29. A composite diaphragm comprising:

a first layer of polytetrafluoroethylene, said first layer having a face surface and a backing surface, said face surface adapted to operatively engage a fluid;

a stud fastened to said first layer, extending substantially orthogonally from said backing surface, said stud being free of said face surface; and a second layer of a thermoplastic elastomeric blend of a thermoplastic material and a fully vulcanized thermoset elastomer, said second layer being fastened to said backing surface.

30. The composite diaphragm of claim 29, wherein said second layer is unreinforced.

31. The composite diaphragm of claim 29, wherein said stud is molded in-situ with said first layer.

32. The composite diaphragm of claim 29, wherein said stud is encapsulated in PTFE and fastened to said first layer with adhesive.

33. The composite diaphragm of claim 29, wherein said stud is encapsulated in modified PTFE and fastened to said first layer by welding.

34. A method of fabricating a composite diaphragm comprising the steps of:

(a) providing a first layer of polytetrafluoroethylene said first layer having a face surface and a backing surface, said face surface adapted to operatively engage a fluid;

(b) fastening a stud to the first layer, extending substantially orthogonally from the backing surface, the stud being free of the face surface;

(c) annealing the first layer by heating the first layer to its gel point, and quenching the first layer while molding the first layer.;

(d) chemically etching a surface of the first layer;

(e) applying an adhesive to the surface of the first layer;

(f) providing a second layer of a thermoplastic elastomer;

(g) disposing the second layer in superposed engagement with the first layer, wherein the adhesive contacts both the backing face of the first layer and the second layer;

(h) applying heat to the superposed first layer and second layer; and (i) applying pressure to the superposed first layer and second layer wherein the first layer is bonded to the second layer to form an integral composite diaphragm.

35. The method of claim 34, wherein said fastening step (b) further comprises molding the stud in-situ with the first layer.

36. The method of claim 34, wherein said fastening step (b) further comprises encapsulating the stud in PTFE and fastening the encapsulated stud to the first layer.

37. The method of claim 34, wherein said heating step (j) further comprises heating the first layer to a temperature of at least substantially 620 degrees F. (326 degrees C.).

38. The method of claim 37, wherein said heating step (j) further comprises heating the first layer to 700 degrees F. (371 degrees C.).

39. The method claim 34, wherein said quenching step (k) further comprises the step of quenching the first layer at a temperature within a range of 50–90 degrees F. (10–32 degrees C.).

40. The method of claim 34, wherein said quenching step (k) further comprises the step of molding the first layer in a mold disposed at a quenching temperature, at a pressure within a range of 1.7 to 5.2 MPa.

41. A method of fabricating a diaphragm comprising the steps of:

(a) providing a stud having a recess disposed therein;

(b) molding the stud in-situ with a first layer of polytetrafluoroethylene to form a pre-mold by heating a portion of the first layer to its gel point and pressing the portion of the first layer into the recess; and (c) annealing the first layer.

42. The method of claim 41, wherein said annealing step (c) is performed integrally with said molding step (b) by utilizing cooled platens to press the heated portion of the first layer into the recess.

43. The method of claim 41, wherein said annealing step (c) is performed upon completion of said molding step (b).

44. The method of claim 41, wherein the recess and the portion of the first layer are interlocked with one another.

45. The method of claim 41, wherein the stud further comprises a mating surface adapted for engagement with the first layer, the recess being defined by walls of the stud which extend divergently from the mating surface.

46. A diaphragm comprising:

a layer of polytetrafluoroethylene, said layer having a face surface and a backing surface, said face surface adapted to operatively engage a fluid;

a stud having a proximal surface disposed in engagement with said layer, said proximal surface having a recess disposed therein, said recess being defined by walls which extend divergently from said proximal surface;

a portion of the first layer being disposed within the recess to mechanically interlock said stud to said layer;

said stud extending substantially orthogonally from said first layer and being free of said face surface.

47. The diaphragm of claim 46, wherein said stud further comprises:

an aperture disposed in said proximal surface and in communication with said recess, said aperture having a first transverse dimension t1 and said recess having a second transverse dimension t2;

a bore disposed in communication with said recess and extending from said recess to a distal end of said stud, said bore having a third transverse dimension t3;

a plug disposed in said bore and extending therefrom into said recess to reduce volume of said recess;

wherein said first transverse dimension is greater than said third transverse dimension and less than said second transverse dimension, $t3<t1<t2$.

48. The diaphragm of claim 47, wherein said plug is disposed integrally with said stud.

49. The diaphragm of claim 47, being fabricated by the steps of:

(a) extending a pin through said bore and into said recess, said pin having a transverse dimension less than that of said plug;

(b) heating said layer to its gel point;

(c) engaging said proximal surface with said layer;

(d) applying pressure to said layer and said stud, wherein a portion of the first layer flows into said recess, into engagement with said stud and with said pin;

(e) replacing said pin with said plug, wherein said plug forms an interference fit with the layer to mechanically interlock said stud with said layer.

50. The diaphragm of claim 46, wherein said stud is fabricated from a polymer.

51. The diaphragm of claim 46, being fabricated by the steps of:

(a) heating said layer to its gel point;

(b) engaging said proximal surface with said layer;

(c) applying pressure to said layer and said stud, wherein a portion of the first layer flows into said recess to mechanically interlock said stud to said layer.

52. The diaphragm of claim 51, wherein said heating step (a) comprises heating to at least about 326 degrees C.

53. A method of fabricating a composite diaphragm comprising the steps of:

(a) providing a first layer of polytetrafluoroethylene said first layer having a face surface and a backing surface, said face surface adapted to operatively engage a fluid;

(b) fastening a stud to the first layer by encapsulating the stud in PTFE and fastening the encapsulated stud to the first layer so that the stud extends substantially orthogonally from the backing surface, the stud being free of the face surface;

(c) annealing the first layer;

(d) chemically etching a surface of the first layer;

(e) applying an adhesive to the surface of the first layer;

(f) providing a second layer of a thermoplastic elastomer;

(g) disposing the second layer in superposed engagement with the first layer, wherein the adhesive contacts both the backing face of the first layer and the second layer;

(h) applying heat to the superposed first layer and second layer; and (i) applying pressure to the superposed first layer and second layer wherein the first layer is bonded to the second layer to form an integral composite diaphragm.

54. The method of claim 53, wherein the adhesive comprises a composition of about 2 weight percent of amino silane monomer and about 98 weight percent methyl isobutyl ketone.

* * * * *